US010900150B2

(12) United States Patent
Aristizabal et al.

(10) Patent No.: US 10,900,150 B2
(45) Date of Patent: Jan. 26, 2021

(54) KNITTED SHOE COMPONENTS AND METHODS OF MAKING THE SAME

(71) Applicant: Ecofibre Limited, Georgetown, KY (US)

(72) Inventors: Juan Aristizabal, Greensboro, NC (US); Jeffrey W. Bruner, Greensboro, NC (US)

(73) Assignee: Ecofibre Limited, Georgetown, KY (US)

( * ) Notice: Subject to any disclaimer, the term of this patent is extended or adjusted under 35 U.S.C. 154(b) by 0 days.

(21) Appl. No.: 15/789,230

(22) Filed: Oct. 20, 2017

(65) Prior Publication Data

US 2018/0055145 A1 Mar. 1, 2018

Related U.S. Application Data

(62) Division of application No. 15/119,411, filed as application No. PCT/US2015/018796 on Mar. 4, 2015, now Pat. No. 9,920,461.

(Continued)

(51) Int. Cl.

| | |
|---|---|
| ***D04B 1/24*** | (2006.01) |
| ***D04B 1/10*** | (2006.01) |
| ***D04B 7/30*** | (2006.01) |

(52) U.S. Cl.

CPC ..... *D04B 1/24* (2013.01); *D04B 1/108* (2013.01); *D04B 7/30* (2013.01); *D10B 2403/0332* (2013.01); *D10B 2501/043* (2013.01)

(58) Field of Classification Search

CPC . D04B 1/24; D04B 1/108; D04B 1/22; D04B 1/26; D04B 7/30; D04B 7/32; A43B 1/04

See application file for complete search history.

(56) References Cited

U.S. PATENT DOCUMENTS 2,047,724 A * 7/1936 Zuckerman ..... D04B 1/24 36/11
2,147,197 A * 2/1939 Glidden ..... A43B 1/02 36/3 A (Continued)

FOREIGN PATENT DOCUMENTS

WO 2015/037540 A1 3/2015

OTHER PUBLICATIONS

International Search Report and Written Opinion issued in corresponding International Application No. PCT/US2015/018796 dated Apr. 22, 2015.

*Primary Examiner* — Danny Worrell

(74) *Attorney, Agent, or Firm* — Vos-IP, LLC

(57) ABSTRACT

In one aspect, methods of making a knitted shoe component are described herein. In some embodiments, a method comprises knitting one or more fibers to form a toe portion; knitting one or more fibers to form a first wing portion; and knitting one or more fibers to form a second wing portion. The first and second wing portions extend from the toe portion and are knittingly connected to the toe portion. The method further comprises reducing the lateral separation between the first and second wing portions from an initial separation distance to a knitting separation distance such that the wing portions can be knitted together to form a seamless heel portion of the shoe component, including using a series of stitch transfer, racking, and knitting steps.

18 Claims, 15 Drawing Sheets

Related U.S. Application Data

(60) Provisional application No. 61/947,793, filed on Mar. 4, 2014.

(56) References Cited

U.S. PATENT DOCUMENTS 2,400,692 A * 5/1946 Herbert ..... A43B 1/04 36/10
5,474,839 A * 12/1995 Ogawa ..... B05D 1/185 428/391
5,566,558 A * 10/1996 Tsuchiya ..... D04B 15/88 66/149 R
6,931,762 B1 * 8/2005 Dua ..... A43B 1/04 12/142 G
7,347,011 B2 * 3/2008 Dua ..... A43B 1/04 36/45
7,738,991 B2 * 6/2010 Klumpp ..... D04B 1/26 66/185
8,448,474 B1 * 5/2013 Tatler ..... A43B 23/0245 66/64
8,745,895 B2 * 6/2014 Sokolowski ..... A43B 3/0031 36/50.1
8,839,532 B2 * 9/2014 Huffa ..... A43B 1/04 36/45
9,510,637 B2 * 12/2016 Podhajny ..... A43B 1/04
9,551,096 B2 * 1/2017 Nishino ..... D04B 1/26
9,644,292 B2 * 5/2017 Kino ..... D04B 1/24
9,968,156 B2 * 5/2018 Huffman ..... A43B 23/024
9,976,236 B2 * 5/2018 Terai ..... D04B 1/24
2013/0145652 A1 6/2013 Podhajny et al.
2014/0150292 A1 * 6/2014 Podhajny ..... A43B 23/0205 36/50.1
2014/0245633 A1 * 9/2014 Podhajny ..... A43B 1/04 36/45
2014/0245634 A1 * 9/2014 Podhajny ..... A43B 23/0245 36/54
2015/0107307 A1 * 4/2015 Kosui ..... D04B 1/22 66/177
2016/0128428 A1 * 5/2016 Ikenaka ..... A43B 23/08 36/45
2016/0143394 A1 * 5/2016 Ikenaka ..... A43B 1/04 36/45
2016/0198797 A1 * 7/2016 Ikenaka ..... A43B 1/04 36/45
2017/0049187 A1 * 2/2017 Aristizabal ..... D04B 1/24

* cited by examiner

120

121
111
120

110

221
220
130
210
211
120
110
(e6)
(e5)
(e4)
(e3)
(e2)
(e1)

(e15)
(e14)
(e13)
(e12)
(e11)
(e10)
(e9)
(e8)
(e7-3)
(e7-2)
(e7-1)
(e7)
130

220
130
210
130
221
220
130
210
211
(e5)
(e4)
(e3)
(e2)
(e1)
120
110

(e12)
(e11)
(e10)
(e9)
(e8)
(e7)
(e6-3)
(e6-2)
(e6-1)
(e6)

250

250

250

KNITTED SHOE COMPONENTS AND METHODS OF MAKING THE SAME

CROSS REFERENCE TO RELATED APPLICATIONS

This application is a divisional of U.S. patent application Ser. No. 15/119,411, filed on Aug. 17, 2016, which is a U.S. national stage application under 35 U.S.C. § 371 of International Application No. PCT/US2015/018796, filed on Mar. 4, 2015, which claims priority pursuant to 35 U.S.C. § 119 to U.S. Provisional Patent Application Ser. No. 61/947,793, filed on Mar. 4, 2014, each of which is hereby incorporated by reference herein its entirety.

FIELD

This invention relates to knitted shoe components and, in particular, to knitted shoe components having a seamless construction and methods of making the same.

BACKGROUND

Textiles and fabrics have been used to form various components or portions of shoes and other footwear, including shoe uppers. However, some prior uses of textiles and/or fabrics to form a shoe upper require stitching of the textiles and/or fabrics to provide a shaped, three-dimensional component. Such three-dimensional components thus include seams. The presence of seams in a shoe upper can reduce the comfort and/or performance of the shoe. Further, the need to stitch portions of textiles and/or fabrics together to form shoe components can substantially reduce the efficiency and/or increase the cost of manufacturing the components.

Therefore, there exists a need for improved shoe components and improved methods of making shoe components.

SUMMARY

In one aspect, methods of making a knitted shoe component are described herein which, in some cases, can provide one or more advantages compared to other methods. For example, in some instances, a method of making a knitted shoe component described herein can provide a knitted shoe component such as a knitted shoe upper that is free of seams, such as seams formed by a sewing or linking process. In particular, a method described herein can be used to form a seamless, three-dimensional knitted shoe component from two or more widely separated portions of a knitted fabric, including portions separated by a distance larger than the maximum racking distance of a knitting machine used to form the fabric. Moreover, a method described herein can provide a knitted shoe component in a more efficient and/or cost-effective manner compared to some other methods.

A method of making a knitted shoe component described herein, in some embodiments, is carried out using a knitting machine, such as a V-bed knitting machine, having a front needle bed and a back needle bed. A four-bed flat knitting machine may also be used to carry out a method described herein. Such a method can comprise knitting one or more fibers to form a toe portion; knitting one or more fibers to form a first wing portion; and knitting one or more fibers to form a second wing portion. The first wing portion has a first edge comprising a plurality of stitches, and the second wing portion has a second edge comprising a plurality of stitches. Moreover, the first and second wing portions each extend from the toe portion and are knittingly connected to the toe portion. In addition, the first and second wing portions are laterally separated from one another by an initial separation distance. The separation distance can be relative to the stitches of the first and second edges. A knitting method described herein, in some cases, further comprises reducing the lateral separation between the first wing portion and the second wing portion from the initial separation distance to a knitting separation distance such that the wing portions can be connected or knitted together to form a seamless heel portion of the shoe component.

As noted above, in some embodiments of a method described herein, knitting is carried out using a V-bed knitting machine. In some such methods, knitting the first wing portion to the second wing portion comprises transferring stitches of the first edge and/or second edge of the wing portions from a rib stitch or knit configuration on the needle beds of the knitting machine to a configuration in which the stitches are positioned on only the front needle bed and/or only the back needle bed of the knitting machine. Moreover, the method can further comprise optionally knitting at least one additional knitted course on each of the first and second wing portions to provide one stitch on each active needle of the front needle bed and the back needle bed, followed by racking the back needle bed and/or the front needle bed to reduce the lateral separation between the first wing portion and the second wing portion. In particular, the lateral separation can be reduced from the initial separation distance to an intermediate separation distance. In addition, this process can be repeated to further reduce the separation distance between the wing portions. In some cases, for example, the method further comprises transferring the stitches of the first edge from the front needle bed to the back needle bed and transferring the stitches of the second edge from the back needle bed to the front needle bed (or vice versa) and racking the back needle bed and/or the front needle bed back to a previous racking position. In this manner, the lateral separation between the first wing portion and the second wing portion can be reduced from the intermediate separation distance to a knitting separation distance.

Once the first and second wing portions are separated by a knitting distance described herein, further knitting steps can be carried out to complete the shoe component. In some embodiments, one or more additional knitting steps are repeated until all or substantially all of the active stitches of the first edge and all or substantially all of the active stitches of the second edge have been used to knittingly join the first wing portion and the second wing portion to form the heel portion.

For example, in some cases, a method described herein further comprises transferring the stitches of the first edge from the back needle bed to the front needle bed and transferring the stitches of the second edge from the front needle bed to the back needle bed, followed by knitting at least one additional course on each of the first edge and the second edge to reduce the number of held stitches on each of the first edge and the second edge by at least one stitch. It is to be understood that knitting at least one additional course on each of the first edge and the second edge can be equivalent to knitting at least one additional course on the heel portion that is being formed by the joining of the first and second wing portions. Moreover, a method described herein can further comprise transferring the remaining held stitches of the first edge from the front needle bed to the back needle bed and transferring the remaining held stitches of the second edge from the back needle bed to the front needle bed. In addition, if desired, the method can further comprise carrying out additional rounds of knitting, racking, and transferring of stitches. For instance, in some embodiments, the method further comprises knitting at least one additional course on each of the first edge and the second edge (or on the heel portion) to further reduce the number of held stitches on each of the first edge and the second edge by at least one stitch; racking the back needle bed and/or the front needle bed to reduce the lateral separation between the first wing portion and the second wing portion; transferring the stitches of the first edge from the back needle bed to the front needle bed and transferring the stitches of the second edge from the front needle bed to the back needle bed; knitting at least one additional course on each of the first edge and the second edge (or on the heel portion) to reduce the number of held stitches on each of the first edge and the second edge by at least one stitch; racking the back needle bed and/or the front needle bed to reduce the lateral separation between the first wing portion and the second wing portion; and transferring the stitches of the first edge from the front needle bed to the back needle bed and transferring the stitches of the second edge from the back needle bed to the front needle bed. As noted above, the foregoing steps can be repeated as needed or desired to complete the shoe component.

It is also possible to carry out a method described herein using a four-bed flat knitting machine. Such a knitting machine, in some cases, can have a front V needle bed, a back V needle bed, a front top needle bed, and a back top needle bed. In some such embodiments, knitting the first wing portion to the second wing portion is carried out in a manner analogous to that described above for a V-bed knitting machine, but adapted for a four-bed knitting machine. For example, in some cases, knitting the first wing portion to the second wing portion comprises transferring the stitches of the first edge from a rib stitch configuration on the back V needle bed to the front top needle bed and transferring the stitches of the second edge from a rib stitch configuration on the front V needle bed to the back top needle bed. The method further comprises racking the back needle beds and/or the front needle beds to reduce the lateral separation between the first wing portion and the second wing portion from the initial separation distance to an intermediate separation distance, followed by transferring the stitches of the first edge from the front needle beds to the back needle beds and transferring the stitches of the second edge from the back needle beds to the front needle beds, and further followed by racking the back needle beds and/or the front needle beds back to the previous racking position to reduce the lateral separation between the first wing portion and the second wing portion to a knitting separation distance. Similarly, as with a method using a V-bed knitting machine, a method of knitting together wing portions with a four-bed flat knitting machine can further comprise transferring the stitches of the first edge from the back needle beds to the front needle beds and transferring the stitches of the second edge from the front needle beds to the back needle beds; knitting at least one additional course on each of the first edge and the second edge to reduce the number of held stitches on each of the first edge and the second edge by at least one stitch; racking the back needle beds and/or the front needle beds to reduce the lateral separation between the first wing portion and the second wing portion; transferring the remaining held stitches of the first edge from the front needle beds to the back needle beds and transferring the remaining held stitches of the second edge from the back needle beds to the front needle beds; racking the back needle beds and/or the front needle beds back to the previous racking position; knitting at least one additional course on each of the first edge and the second edge to reduce the number of held stitches on each of the first edge and the second edge by at least one stitch; transferring the remaining held stitches of the first edge from the back needle beds to the front needle beds and transferring the remaining held stitches of the second edge from the front needle beds to the back needle beds; and knitting at least one additional course on each of the first edge and the second edge to reduce the number of held stitches on each of the first edge and the second edge by at least one stitch. Moreover, the final racking, transferring, racking, knitting, transferring, and knitting steps can be repeated until substantially all of the stitches of the first edge and substantially all of the stitches of the second edge have been used to knittingly join the first wing portion to the second wing portion to form the heel portion.

Additionally, in some instances, a method described herein further comprises knitting one or more fibers to form an insole portion extending from the heel portion, wherein the insole portion is knittingly connected to the heel portion. Moreover, in some cases, the method also comprises joining the insole portion to one or more of the first wing portion, the second wing portion, and the toe portion. In some embodiments, joining is carried out by sewing or linking.

In another aspect, knitted shoe components are described herein which, in some embodiments, may exhibit one or more desirable properties or features compared to other shoe components. For example, in some cases, a knitted shoe component described herein forms a three-dimensional shoe upper that is free of seams in contact with the side, top, or heel of the foot of a wearer of the shoe upper. A knitted shoe component described herein, in some embodiments, comprises a toe portion; a first wing portion extending from the toe portion and knittingly joined to the toe portion; a second wing portion extending from the toe portion and knittingly joined to the toe portion; and a heel portion, wherein the first wing portion and the second wing portion are knittingly joined to one another at the heel portion, including in a manner that forms or defines the heel portion. In some cases, a knitted shoe component described herein further comprises an insole portion extending from the heel portion and knittingly joined to the heel portion.

In still another aspect, methods of making a shoe are described herein. In some embodiments, a method of making a shoe comprises making a knitted shoe component in a manner described hereinabove and attaching the knitted shoe component to one or more additional shoe components, such as a tongue component and/or a sole component.

In yet another aspect, shoes are described herein. In some embodiments, a shoe described herein comprises a knitted shoe component described hereinabove and one or more additional shoe components attached to the knitted shoe component. The one or more additional shoe components can include a tongue component, a sole component, and/or another type of shoe component.

These and other embodiments are described in more detail in the detailed description which follows.

BRIEF DESCRIPTION OF THE FIGURES

FIGS. 14-19 illustrate knitted shoe components and portions of knitted shoe components according to some embodiments described herein.

DETAILED DESCRIPTION

Figures 1A, 1B, 1C, 1D, 1E:
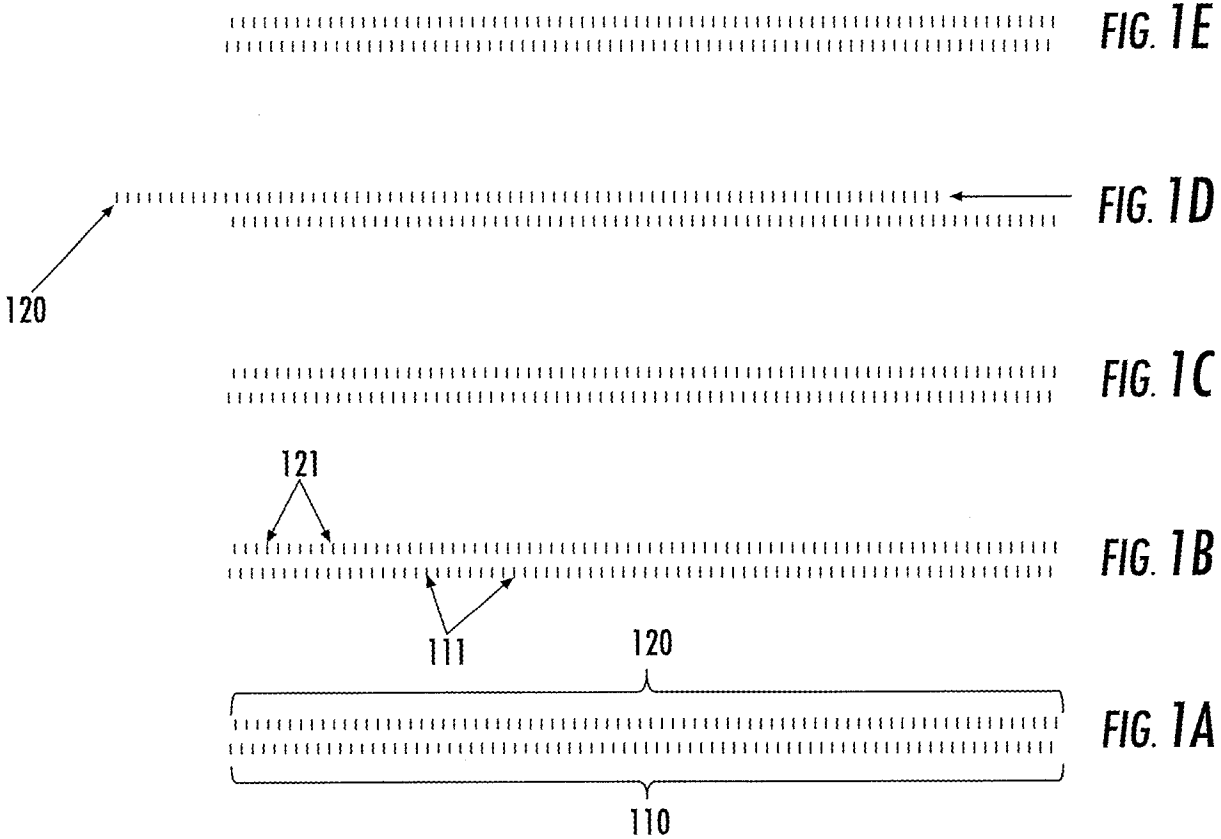
FIGS. 1A-1E illustrate components of a V-bed knitting machine used to carry out a method of making a knitted shoe component according to some embodiments described herein.

Embodiments described herein can be understood more readily by reference to the following detailed description, examples, and figures. Elements, apparatus, and methods described herein, however, are not limited to the specific embodiments presented in the detailed description, examples, and figures. It should be recognized that these embodiments are merely illustrative of the principles of the present invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

All ranges disclosed herein are also to be considered to include the end points of the range, unless expressly stated otherwise. For example, a range of "between 5 and 10" should generally be considered to include the end points 5 and 10.

I. Methods of Making a Knitted Shoe Component

In one aspect, methods of making a three-dimensional knitted shoe component are described herein. As described hereinabove, such a method can be carried out with a knitting machine. Any knitting machine not inconsistent with the objectives of the present invention may be used. In some cases, for example, a V-bed flat knitting machine is used. In other cases, a four-bed flat knitting machine is used. Further, a knitting machine described herein can be used to carry out weft knitting. However, it should be noted that a method of making a knitted shoe component described herein, including a seamless three-dimensional knitted shoe component, can be carried out without the use of a circular knitting machine or a circular knitting method.

In addition, a knitting machine used in a method described herein can be automated. For example, in some cases, a knitting machine is configured to carry out a knitting process according to needle-by-needle or stitch-by-stitch instructions provided by a computer as a function of space and/or time. The computer can include a processor and a memory storing computer-readable program code portions that, in response to execution by the processor, cause instructions to be provided to one or more components of a knitting machine in a desired sequence.

In some embodiments, the knitting machine has a front needle bed and a back needle bed, and the method comprises (a) knitting one or more fibers to form a toe portion; (b) knitting one or more fibers to form a first wing portion extending from the toe portion and knittingly connected to the toe portion, the first wing portion having a first edge comprising a plurality of stitches; and (c) knitting one or more fibers to form a second wing portion extending from the toe portion and knittingly connected to the toe portion and laterally separated from the first wing portion by an initial separation distance, the second wing portion having a second edge comprising a plurality of stitches. A "fiber," for reference purposes herein, can mean a fiber, yarn, or filament. A "lateral" separation, for reference purposes herein, comprises a separation in a plane or direction parallel to the long axis of the front and back needle beds. The lateral separation direction can thus be aligned with the knitting direction of the machine and perpendicular to the direction of stitch formation of the front and back needle beds. In addition, a "toe portion" of a knitted shoe component, for reference purposes herein, can include the toe box and the vamp of a shoe upper. A "vamp," for reference purposes herein, can refer to the portion of a shoe upper that at least partially covers the top part of the foot of a wearer between the toes and the ankle. A shoe "upper," for reference purposes herein, can comprise any portion of a shoe higher than the sole. Similarly, a "wing portion," for reference purposes herein, can include all or a portion of the medial or lateral portion of a shoe upper.

Returning to the knitting process, a method described herein further comprises (d) disposing the stitches of the first edge and the stitches of the second edge in a rib knit configuration on the front needle bed and the back needle bed; and (e) knitting (or knittingly connecting) the first wing portion to the second wing portion to form a heel portion.

In some cases, knitting the first wing portion to the second wing portion comprises (e1) transferring the stitches of the first edge to the front needle bed and transferring the stitches of the second edge to the back needle bed; and (e2) optionally knitting at least one additional knitted course on each of the first and second wing portions to provide one stitch on each active needle of the front needle bed and the back needle bed. An "active" needle, for reference purposes herein, comprises a needle that is holding at least one stitch, as opposed to an "inactive" needle that is not holding a stitch. In addition, in some cases, the method further comprises (e3) racking the back needle bed and/or the front needle bed to reduce the lateral separation between the first wing portion and the second wing portion from the initial separation distance to an intermediate separation distance; (e4) transferring the stitches of the first edge from the front needle bed to the back needle bed and transferring the stitches of the second edge from the back needle bed to the front needle bed; and (e5) racking the back needle bed and/or the front needle bed back to the position of step (e1) to reduce the lateral separation between the first wing portion and the second wing portion from the intermediate separation distance to a knitting separation distance. It should be noted that, in some embodiments, the position of step (e1) can be the "zero" position of the relevant needle beds and/or knitting machine.

Further, as understood by one of ordinary skill in the art, "racking" a needle bed of a knitting machine described herein comprises moving the needle bed laterally relative to another needle bed, such as a needle bed in facing opposition to the "racked" needle bed. A "knitting separation distance," for reference purposes herein, comprises a distance between two edges of stitches that is sufficiently small for the two edges to be knittingly joined to one another by the knitting machine using a rib knit configuration of the stitches on a front needle bed and a back needle bed (although it is be understood that knitting may subsequently include configurations other than a rib knit configuration). In some cases, therefore, a knitting separation distance is equal to or greater than a maximum racking distance of the rib knit configuration. The "maximum racking distance" of the rib knit configuration, for reference purposes herein, comprises the maximum distance that the front needle bed(s) and/or the back needle bed(s) can be racked without breaking one or more loops of the rib knit configuration or one or more needles of a front needle bed and/or a back needle bed. Further, the maximum racking distance of a rib knit configuration can vary based on one or more of the needle gauge, the needle type, the needle material, the fiber material, the fiber denier, and the configuration of the knitting machine. In addition, a knitting separation distance described herein can be a constant and uniform knitting separation distance or a distance that varies as the knitting method progresses. In particular, the knitting separation distance can decrease as the two wings are brought together and joined according to a method described herein. It is also possible for the knitting separation distance to increase to some extent during the knitting process, such as may be required to shape the heel portion or a heel pouch defined by the heel portion.

Once the first and second wing portions are separated by a knitting distance described herein, further knitting steps can be carried out to complete the shoe component. In particular, further knitting steps can be carried out to actually form the heel portion itself or to "close the heel" of the shoe component. In some cases, an initial step in the actual heel closing or heel forming process (once an appropriate knitting distance has been obtained and once the stitches and needle beds have been placed in an appropriate position described herein) comprises forming or knitting a welt. A "welt," as understood by one of ordinary skill in the art, can refer to a finished edge of an edge knit first knitted fabric, component, or workpiece. Such a welt, in some instances, can prevent the fabric, component, or fabric from rolling up or otherwise losing its intended geometry. A welt formed in a method described herein can be any type of welt not inconsistent with the objectives of the present invention. In some embodiments, for example, the welt is a "French" or "tubular" welt. A welt can also be an "English" or "rolled" welt or a "racked" welt. Additionally, as described further hereinbelow, a welt formed in a method described herein can have any desired thickness. Moreover, it is to be understood that a welt described herein can be a separate portion of material to which the first and second wing portions are each subsequently joined, including by a knitting process.

Thus, in some cases, knitting the first wing portion to the second wing portion to form the heel portion further comprises (e6) transferring the stitches of the first edge from the back needle bed to the front needle bed and transferring the stitches of the second edge from the front needle bed to the back needle bed; and (e7) knitting or forming a welt between the first wing portion and the second wing portion. In some embodiments, the welt at least partially spans the needles disposed in the lateral separation distance between the first wing portion and the second wing portion. In some cases, the welt completely or substantially completely spans this distance, such that at least about 90%, at least about 95%, or at least about 98% of the lateral separation distance is spanned by the welt. Further, in some instances, knitting or forming a welt can be carried out in a plurality of knitting steps. For example, in some embodiments, knitting the welt comprises (e7-1) disposing a plurality of stitches in a rib knit configuration on needles of the front needle bed and the back needle bed within the "gap" defining the knitting separation distance of the method. Moreover, in some cases, such a step can be carried out by knitting at least one additional course on each of the first and second wing portions to provide one stitch on each active needle of the front needle bed and the back needle bed. Additionally, to form a French or tubular welt, for instance, knitting the welt can further comprise (e7-2) disposing or knitting a plurality of stitches in a jersey knit configuration on needles of the front needle bed and/or the back needle bed within the gap defining the knitting separation distance of the method; and (e7-3) disposing or knitting a plurality of stitches in a jersey knit configuration on needles of the opposite needle bed (front or back) as in step (e7-2), the needles being within the gap defining the knitting separation distance. To faun another type of welt, such as an English welt or a racked welt, steps (e7-2) and (e7-3) can be replaced by knitting steps corresponding to these welt types, as understood by one of ordinary skill in the art. Moreover, steps (e7-2) and (e7-3) (or the corresponding steps for other welt types) can be repeated any desired number of times to increase the thickness of the welt.

Following formation of a welt in a manner described herein, additional knitting steps can be undertaken to complete the heel closure and the shoe component. In general, the additional knitting steps can comprise knitting a plurality of additional courses on each of the first edge and the second edge to reduce the number of held stitches on each of the first edge and the second edge. A "held" stitch, for reference purposes herein, comprises a stitch of the first edge or the second edge held by a needle that is farther from the second edge or first edge, respectively, than the knitting separation distance. Knitting each additional course in a manner described above can reduce the number of held stitches by one stitch. Moreover, the number of additional courses knitted on the first edge and the second edge can generally correspond to the number of held stitches. In this manner, all of the held stitches are eventually used to form the heel portion of the shoe component. It is further to be understood that "closing the heel" of the shoe component in such a manner can also include carrying out other specific steps necessary to permit the knitting of the additional courses using the held stitches of the first and second edges. Some such steps are described further hereinbelow.

For example, in some embodiments, a method described herein can further comprise (e8) knitting at least one additional course on each of the first edge and the second edge to reduce the number of held stitches on each of the first edge and the second edge by at least one stitch; and (e9) racking the back needle bed and/or the front needle bed to reduce the lateral separation between the first wing portion and the second wing portion. Moreover, in some cases, the method can further comprise (e10) transferring the remaining held stitches of the first edge from the front needle bed to the back needle bed and transferring the remaining held stitches of the second edge from the back needle bed to the front needle bed; and (e11) racking the back needle bed and/or the front needle bed back to the position of step (e8). As described above, the position of (e8), in some instances, comprises the zero position of the needle beds and/or knitting machine. Following this racking step, the method can further comprise (e12) knitting at least one additional course on each of the first edge and the second edge to reduce the number of held stitches on each of the first edge and the second edge by at least one stitch in the same manner as described hereinabove. Next, the method can comprise (e13) racking the back needle bed and/or the front needle bed to reduce the lateral separation between the first wing portion and the second wing portion, where the racking of step (e13) is carried out in a direction opposite to that carried out in step (e9) above. The method can further comprise (e14) transferring the stitches of the first edge from the back needle bed to the front needle bed and transferring the stitches of the second edge from the front needle bed to the back needle bed; and (e15) racking the back needle bed and/or the front needle bed back to the position of step (e8).

Moreover, in some cases, knitting the first wing portion to the second wing portion to form the heel portion or "close the heel" further comprises repeating steps (e8) through (e15) above until substantially all of the stitches of the first edge and substantially all of the stitches of the second edge have been used to knittingly join the first wing portion to the second wing portion to form the heel portion. Thus, in this manner, a V-bed knitting machine can be used to provide a knitted shoe upper that is entirely or substantially entirely formed into a three-dimensional shape using a knitting process only, as opposed to a knitting process in combination with another joining process, such as a sewing or linking process.

As described herein, it is also possible to make a knitted shoe component such as a shoe upper using a knitting machine other than a V-bed knitting machine. For example, in some cases, a knitting machine having a front V needle bed, a back V needle bed, a front top needle bed, and a back top needle bed is used. In such cases, a method of making a knitted shoe component can comprise (a) knitting one or more fibers to form a toe portion; (b) knitting one or more fibers to form a first wing portion extending from the toe portion and knittingly connected to the toe portion, the first wing portion having a first edge comprising a plurality of stitches; (c) knitting one or more fibers to form a second wing portion extending from the toe portion and knittingly connected to the toe portion and laterally separated from the first wing portion by an initial separation distance, the second wing portion having a second edge comprising a plurality of stitches; (d) disposing the stitches of the first edge and the stitches of the second edge in a rib knit configuration on the front V needle bed and the back V needle bed; and (e) knitting the first wing portion to the second wing portion to form a heel portion. Moreover, knitting the first wing portion to the second wing portion to form the heel portion or "close the heel" can be carried out by (e1) transferring stitches of the first edge from the back V needle bed to the front top needle bed and transferring stitches of the second edge from the front V needle bed to the back top needle bed; (e2) racking the back needle beds and/or the front needle beds to reduce the lateral separation between the first wing portion and the second wing portion from the initial separation distance to an intermediate separation distance; (e3) transferring the stitches of the first edge from the front top needle bed to the back V needle bed and from the front V needle bed to the back top needle bed, and transferring the stitches of the second edge from the back top needle bed to the front V needle bed and from the back V needle bed to the front top needle bed; and (e4) racking the back needle beds and/or the front needle beds back to the position of step (e1) to reduce the lateral separation between the first wing portion and the second wing portion from the intermediate separation distance to a knitting separation distance.

In addition, as with a method carried out using a V-bed knitting machine, once a knitting separation distance between the wing portions is obtained, it is possible to carry out additional knitting steps with a four-bed knitting machine to form a seamless knitted shoe component. In particular, further knitting steps can be carried out to actually form the heel portion itself or to "close the heel" of the shoe component. In some cases, an initial step in the actual heel closing or heel forming process (once an appropriate knitting distance has been obtained and once the stitches and needle beds have been placed in an appropriate position described herein) comprises forming or knitting a welt. The welt can comprise any welt described hereinabove for a V-bed knitting machine, such as a French welt, an English welt, or a racked welt.

Therefore, in some cases, knitting the first wing portion to the second wing portion further comprises (e5) transferring the stitches of the first edge from the back top needle bed to the front V needle bed and transferring the stitches of the second edge from the front top needle bed to the back V needle bed; and (e6) knitting or forming a welt between the first wing portion and the second wing portion. In some embodiments, the welt at least partially spans the needles disposed in the lateral separation distance between the first wing portion and the second wing portion. In some cases, the welt completely or substantially completely spans this distance, such that at least about 90%, at least about 95%, or at least about 98% of the lateral separation distance is spanned by the welt. Further, in some instances, knitting or forming a welt can be carried out in a plurality of knitting steps. For example, in some embodiments, knitting the welt comprises (e6-1) disposing a plurality of stitches in a rib knit configuration on needles of the front needle beds and the back needle beds within the "gap" defining the knitting separation distance of the method. Further, in some cases, such a step can be carried out by knitting at least one additional course on each of the first and second wing portions to provide one stitch on each active needle of the front needle beds and the back needle beds. Additionally, to faun a French welt, for instance, knitting the welt can further comprise (e6-2) disposing or knitting a plurality of stitches in a jersey knit configuration on needles of the front needle bed(s) or back needle bed(s) within the gap defining the knitting separation distance; and (e6-3) disposing or knitting a plurality of stitches in a jersey knit configuration on needles of the opposite needle bed(s) (front or back) as in step (e6-2), the needles being within the gap defining the knitting separation distance. To form another type of welt, such as an English welt or a racked welt, steps (e6-2) and (e6-3) can be replaced by knitting steps corresponding to these welt types, as understood by one of ordinary skill in the art. Moreover, steps (e6-2) and (e6-3) (or the corresponding steps for other welt types) can be repeated any desired number of times to increase the thickness of the welt.

Following formation of a welt in a manner described herein, additional knitting steps can be undertaken to complete the heel closure and the shoe component, as described above for a V-bed knitting machine. In general, the additional knitting steps can comprise knitting a plurality of additional courses on each of the first edge and the second edge to reduce the number of held stitches on each of the first edge and the second edge. Knitting each additional course in a manner described above can reduce the number of held stitches by one stitch. Moreover, the number of additional courses knitted on the first edge and the second edge can generally correspond to the number of held stitches. In this manner, all of the held stitches can eventually be used to form the heel portion of the shoe component. Again, as with a V-bed knitting machine, it is further to be understood that "closing the heel" of the shoe component can also include carrying out other specific steps necessary to permit the knitting of the additional courses using the held stitches of the first and second edges. Some such steps are described further hereinbelow.

For example, in some embodiments, a method described herein can further comprise (e7) knitting at least one additional course on each of the first edge and the second edge to reduce the number of held stitches on each of the first edge and the second edge by at least one stitch; (e8) transferring the remaining held stitches of the first edge from the back V needle bed to the front top needle bed and transferring the remaining held stitches of the second edge from the front V needle bed to the back top needle bed; (e9) racking the back needle beds and/or the front needle beds to reduce the lateral separation between the first wing portion and the second wing portion; (e10) transferring the remaining held stitches of the first edge from the front top needle bed to the back V needle bed and from the front V needle bed to the back top needle bed, and transferring the remaining held stitches of the second edge from the back top needle bed to the front V needle bed and from the back V needle bed to the front top needle bed; and (e11) racking the back needle beds and/or the front needle beds back to the position of step (e7). The position of step (e7), in some instances, comprises a zero position of the needle beds and/or the knitting machine. The method can further comprise (e12) transferring the remaining held stitches of the first edge from the back top needle bed to the front V needle bed and transferring the remaining held stitches of the second edge from the front top needle bed to the back V needle bed.

Moreover, in some embodiments, knitting the first wing portion to the second wing portion further comprises repeating steps (e7) through (e12) above until substantially all of the stitches of the first edge and substantially all of the stitches of the second edge have been used to knittingly join the first wing portion to the second wing portion to form or close the heel portion.

Additionally, as an alternative to carrying out steps (e7)-(e12) above, it is also possible to close the heel using a four-bed knitting machine by maintaining a rib knit configuration on both the first wing portion and the second wing portion. In such an instance, the method can further comprise knitting a plurality of additional courses on each of the first edge and the second edge until all of the held stitches on each of the first edge and the second edge are knittingly joined in a rib knit configuration to complete formation of the heel portion.

Regardless of the type of knitting machine used, methods described herein can include reducing the distance between wing portions of a knitted shoe component. For example, the distance between wing portions can be reduced from an initial separation distance to an intermediate separation distance and/or a knitting separation distance. The initial separation distance can be any distance not inconsistent with the objectives of the present invention. Moreover, the initial separation distance can depend on a desired size or shape of the knitted shoe component and/or the configuration of the knitting machine. In some cases, the initial separation distance is greater than a maximum racking distance of the stitches of the first edge and the stitches of the second edge in a rib knit configuration described herein. In some embodiments, the initial separation distance is greater than about 3 inches. In other cases, the initial separation distance is greater than about 4 inches or greater than about 5 inches. In some instances, the initial separation distance is between about 1.5 inches and about 24 inches, between about 2 inches and about 18 inches, between about 2 inches and about 12 inches, between about 3 inches and about 24 inches, between about 3 inches and about 10 inches, between about 4 inches and about 12 inches, or between about 4 inches and about 10 inches. Other initial separation distances may also be used in a method described herein.

Similarly, in some embodiments, the knitting separation distance of the method is equal to or less than the maximum racking distance. In some instances, the knitting separation distance is about 1 inch. In some cases, the knitting separation distance is between about 0.5 inches and about 1.5 inches or between about 1 inch and about 2 inches. In some embodiments, the knitting separation distance is greater than about 1 inch, greater than about 1.5 inches, or greater than about 2 inches. In some cases, the knitting separation distance can be less than about 1 inch or less than about 0.5 inches. In some embodiments, for instance, the knitting separation distance corresponds to the width of two needles of the front needle bed(s) and two needles of the back needle bed(s).

Additionally, the first and/or second wing portions joined according to a method described herein can have any size and/or shape not inconsistent with the objectives of the present invention. In some cases, the size and/or shape of the first and/or second wing portion is selected based on a desired configuration of the resulting heel portion. For example, in some instances, the first and/or second wing portions are selected to provide a shaped heel portion. In addition, the first and/or second wing portion can include one or more features or subcomponents. In some cases, for instance, forming the first wing portion and/or the second wing according to a method described herein includes forming eyelets in the first wing portion and/or the second wing portion. The eyelets can be seamless and integrally and/or simultaneously constructed with the first wing portion and/or second wing portion. Further, such eyelets, if desired, can be used to receive shoe laces, hook-and-loop attachment strips such as Velcro strips, or other attachment or fastening components of a shoe or shoe component.

Moreover, in some embodiments, a method of making a knitted shoe component described herein further comprises one or more additional steps following formation of a heel portion, including one or more additional knitting steps. For example, in some cases, a method described herein further comprises (g) knitting one or more fibers to form an insole portion extending from the heel portion, wherein the insole portion is knittingly connected to the heel portion. Additionally, in some such instances, a method further comprises (h) joining the insole portion to one or more of the first wing portion, the second wing portion, and the toe portion at a location other than the knitted junction of the insole portion with the heel portion. Any suitable method of further joining the insole portion to one or more other components of the knitted shoe component can be used. For example, in some cases, the insole portion is joined to one or more of the first wing portion, the second wing portion, and the toe portion by sewing or linking. An "insole" portion, for reference purposes herein, can define the interior bottom of a shoe or shoe component and can be positioned directly beneath the foot of a wearer of the shoe or shoe component.

Further, it is to be understood that methods of making a knitted shoe component described herein can be carried out using any fibers not inconsistent with the objectives of the present invention, where "fibers" can refer collectively to fibers, yarns, and filaments. In some cases, for instance, a knitted shoe component is formed from a single component yarn, a bi-component yarn, or a combination thereof. A bi-component yarn can have a sheath/core structure, a side-by-side structure, or an islands-in-the-sea structure. Other bi-component yarn structures can also be used. Further, in some embodiments, a knitted shoe component is formed from a monofilament yarn, a multifilament yarn, or a combination thereof. A yarn used in a method described herein may also include separate filaments formed from different materials, or a plurality of filaments that are each formed from two or more different materials.

Additionally, in some instances, a knitted shoe component described herein is at least partially formed from an elastomeric yarn or a heat-fusible yarn. For example, in some embodiments, stable and elastic single component multifilament and/or monofilament yarns are used. In some such cases, the yarns can be formed from low melting point polymers, such as polymers having a melting point below about 200° C., 150° C., below about 100° C., or below about 80° C. In some embodiments, the yarns can be formed from polymers having a melting point between about 80° C. and about 150° C. Such yarns can be heated, with or without pressure, to cause the low melting components to melt and flow, thereby modifying the physical properties of the knitted shoe component, including by serving as an adhesive. In other cases, stable and elastic bi-component multifilament and/or monofilament yarns are used. In some such embodiments, the yarns can be formed from low melting polymers in combination with higher melting point polymers (such as polyester or nylon), such that the low melting polymer components but not the higher melting components of the yarns can be made to melt and flow by the application of heat with or without pressure, thereby modifying the physical properties of the knitted shoe component in a desired manner, including by providing an adhesive element and/or structural support.

A fiber, yarn, or filament or a portion of a fiber, yarn, or filament described here can comprise or be formed from any material not inconsistent with the objectives of the present invention. In some embodiments, for example, a fiber, yarn, or filament comprises or is formed from a synthetic material such as nylon or another polyamide, polyester, polyethylene, polypropylene, polybutylene, or another polyolefin, or polyacrylic. In other cases, a fiber, yarn, or filament comprises or is formed from a natural fiber material such as cotton, wool, or silk. Other fibers, yarns, and filament materials may also be used, such as regenerated cellulose or rayon. A fiber, yarn, or filament described herein can also be coated with one or more additional materials to provide a desired property. In some cases, for instance, a fiber, yarn, or filament can be coated with a fluorocarbon such as polytetrafluoroethylene. A fiber, yarn, or filament described herein can also include one or more additives, including polymer additives, which can provide heat absorption and/or heat reflectivity properties. Non-limiting examples of thermally conductive additives which may be used in some embodiments described herein include ceramics such as aluminum nitride and/or boron nitride ceramics, metals such as aluminum or copper, and nanoscale carbon materials such as carbon fibers, carbon nanotubes, and graphite nanoplatelets. Additives comprising thermochromic or photochromic pigment and dye materials may also be used. Such pigment and dye materials can change color in response to heat or light. It is also possible to incorporate one or more antimicrobial or antifungal materials into or onto a fiber, yarn, or filament described herein. Non-limiting examples of antimicrobial or antifungal materials that may be used in some embodiments described herein include inorganic, organic, and/or metal-containing antimicrobial materials such as materials comprising silver, copper, and/or zinc, and quaternary silane-based antimicrobial materials.

Moreover, a fiber, yarn, or filament described herein can have any size, shape, and/or denier not inconsistent with the objectives of the present invention.

In addition, a knitted shoe component formed by a method described herein can comprise regions having the same or differing properties. For example, in some cases, a knitted shoe component can have regions of the same or differing stability, rigidity, elasticity, support, softness, cover, durability against fraying, durability against unraveling, cushioning, compression, breathability, weight, density, color, water wicking ability, and/or water resistance. Further, the properties of a region of a knitted shoe component described herein can be selected based on the type of knitting process, the type of stitch, and/or the chemical composition or type of fiber, yarn, or filament used to form the region. Thus, by selectively forming regions having differing properties, a shoe component can be provided that has both a unitary knitted structure and also complex features, varied regions, or features or regions selected for specific applications. The unitary structure can be formed by a single knitting operation according to a method described herein.

For example, a knitted shoe component made by a method described herein can have one or more regions of high breathability (such as may be provided by the use of a meshed stitch structure), one or more regions of high elasticity (such as may be provided by the use of an elastomeric yarn), one or more regions of high rigidity (such as may be provided by the use of a non-elastomeric yarn), and/or one or more regions that can be shaped using a heat treatment (such as may be provided by the use of a fusible yarn). In another instance, a knitted shoe component made by a method described herein can include relatively soft regions and relatively abrasion resistant regions. A soft region may be located in the inside or interior of the knitted shoe component, and an abrasion resistant region may be located on the outside or exterior of the knitted shoe component, relative to the foot of a wearer. Selectively varying the type of knitting process, the type of stitch, and/or the chemical composition or type of fiber, yarn, or filament used during a method described herein can also provide a knitted shoe component having desired aesthetic, design, or texture elements. For example, in some embodiments, a knitted shoe component does not have a uniform or substantially uniform thickness, but instead defines contours, ridges, or other patterns.

II. Knitted Shoe Components

In another aspect, three-dimensional knitted shoe components are described herein. A "three-dimensional" knitted shoe component, for reference purposes herein, is a shaped component formed by arranging one or more fabrics in a three-dimensional configuration, as opposed to a "flat" configuration of the fabrics. Such knitted shoe components can be formed by a method described hereinabove in Section I. Further, the knitted shoe components can have any form or define any structural or other feature of a shoe not inconsistent with the objectives of the present invention. In some embodiments, for instance, a knitted shoe component described herein comprises, forms, or defines a shoe upper. In other cases, a knitted shoe component comprises, forms, or defines an interior lining of a shoe or other footwear, such as a sock liner.

Further, a knitted shoe component described herein can exhibit a stitch and/or knit structure corresponding to steps of a method described hereinabove in Section I. For example, in some cases, a three-dimensional knitted shoe supper described herein has a stitch and/or knit structure that is continuous, repeating, and/or seamless throughout the entire upper or a portion or region of the upper, such as a heel portion. A knitted shoe component described herein can thus have a knit or stitch structure that distinguishes the shoe component from other shoe components, including some other shoe components made by a method that differs from a method described herein or that is not capable of forming a knit or stitch structure such as those described herein. For example, in some embodiments, the stitch and/or knit structure of a knitted shoe component described herein differs from the stitch and/or knit structure provided by a circular knitting process.

In some embodiments, a knitted shoe component described herein comprises a toe portion; a first wing portion extending from the toe portion and knittingly joined to the toe portion; a second wing portion extending from the toe portion and knittingly joined to the toe portion; and a heel portion, wherein the first wing portion and the second wing portion are knittingly joined to one another at the heel portion. In addition, in some cases, a knitted shoe component described herein further comprises an insole portion extending from the heel portion and knittingly joined to the heel portion. It is to be understood that the foregoing portions of a knitted shoe component described herein can each exhibit a knit or stitch structure corresponding to a method described hereinabove in Section I. For example, in some embodiments, a knitted shoe component described herein comprises a welt (such as a welt described hereinabove in Section I) in the heel portion of the shoe component, in addition to a welt that may be included in another portion of the shoe component, such as the toe portion. Therefore, in some instances, a knitted shoe component described herein includes a plurality of welts, including a first welt in the toe portion and a second welt in the heel portion of the knitted shoe component.

Moreover, in some embodiments, a knitted shoe component described herein does not include a seam. A "seam," for reference purposes herein, comprises a line or ridge where two or more portions or layers of fabric are connected by stitches, staples, an adhesive, or a similar joining means. Thus, the term "seam" does not include a line or area at which two portions of fabric (such as a first and second wing portion described herein) are joined by a continuous knitting process, such as a knitting process described herein. The presence of one or more seams in a shoe component can cause abrasion or other discomfort to a wearer, or else require covering or cushioning in some manner. Therefore, a seamless knitted shoe component described herein can provide manufacturing and use advantage, compared to some other knitted shoe components.

III. Methods of Making a Shoe

In another aspect, methods of making a shoe are described herein. A "shoe," for reference purposes herein, can comprise any outer footwear not inconsistent with the objectives of the present invention. For example, in some cases, a shoe can be an athletic shoe or other athletic footwear, including a shoe or other footwear specifically designed for baseball, basketball, boating or other water sports, cross-training, football, hiking, hockey, running, soccer, or walking activities. A shoe can also be a non-athletic shoe or other footwear, such as a deck shoe, dress boot, dress shoe, loafer, sandal, or work boot.

A method of making a shoe described herein, in some embodiments, comprises making a knitted shoe component according to a method described hereinabove in Section I and attaching the knitted shoe component to one or more additional shoe components. Any additional shoe components not inconsistent with the objectives of the present invention may be used. In addition, one or more additional shoe components can be attached to a knitted shoe component described herein in any manner known in the art and not inconsistent with the objectives of the present invention. For example, in some cases, an additional shoe component comprises a tongue component. The tongue component can be sewn, stapled, glued, or otherwise attached to the knitted shoe component, which may comprise a shoe upper.

In other cases, an additional shoe component comprises a sole component. A sole component can include a midsole and/or an outsole. An "outsole," for reference purposes herein, comprises the portion of the shoe in direct contact with the ground during normal use of the shoe. Thus, the outsole can be the portion of the shoe farthest from the upper, including an upper formed defined by a knitted shoe component described herein. A "midsole," for reference purposes herein, can comprise a layer disposed between the outsole and an insole of the shoe. In some cases, the midsole of a shoe described herein includes or is formed from a shock absorbent material. Moreover, a sole component can be attached to a knitted shoe component in any manner not inconsistent with the objectives of the present invention. In some cases, for instance, a sole component is glued to a knitted shoe component described herein. Other methods of attachment may also be used.

IV. Shoes

In another aspect, shoes are described herein. A shoe described herein can be an athletic shoe or other athletic footwear, including a shoe or other footwear specifically designed for baseball, basketball, boating or other water sports, cross-training, football, hiking, hockey, running, soccer, or walking activities. A shoe can also be a non-athletic shoe or other footwear, such as a deck shoe, dress boot, dress shoe, loafer, sandal, or work boot. Further, a shoe described herein can be formed by a method described hereinabove in Section III. Further, a shoe or component of a shoe can have any structure not inconsistent with the objectives of the present invention, including any structure described hereinabove in Section II or Section III.

In some embodiments, a shoe comprises a knitted shoe component described hereinabove in Section II and one or more additional shoe components attached to the knitted shoe component. Any additional shoe components not inconsistent with the objectives of the present invention may be used. In some cases, for instance, an additional shoe component comprises a tongue component. In other cases, an additional shoe component comprises a sole component, such as a midsole or outsole.

Some embodiments described herein are further illustrated in the following non-limiting examples. The following examples and the foregoing description are directed to the fabrication of various three-dimensional shoes and shoe components, including seamless knitted shoes and shoe components. However, it should be noted that methods described herein, including methods of reducing the lateral separation distance between knitted fabric portions, can be expanded and applied more generally to the knitting of other three-dimensional fabrics that are not necessarily a shoe component.

EXAMPLE 1

V-Bed Knitting

Figures 3A, 3B, 3C, 3D, 3E, 3F, 3G, 3H, 3I, 3J, 3K:
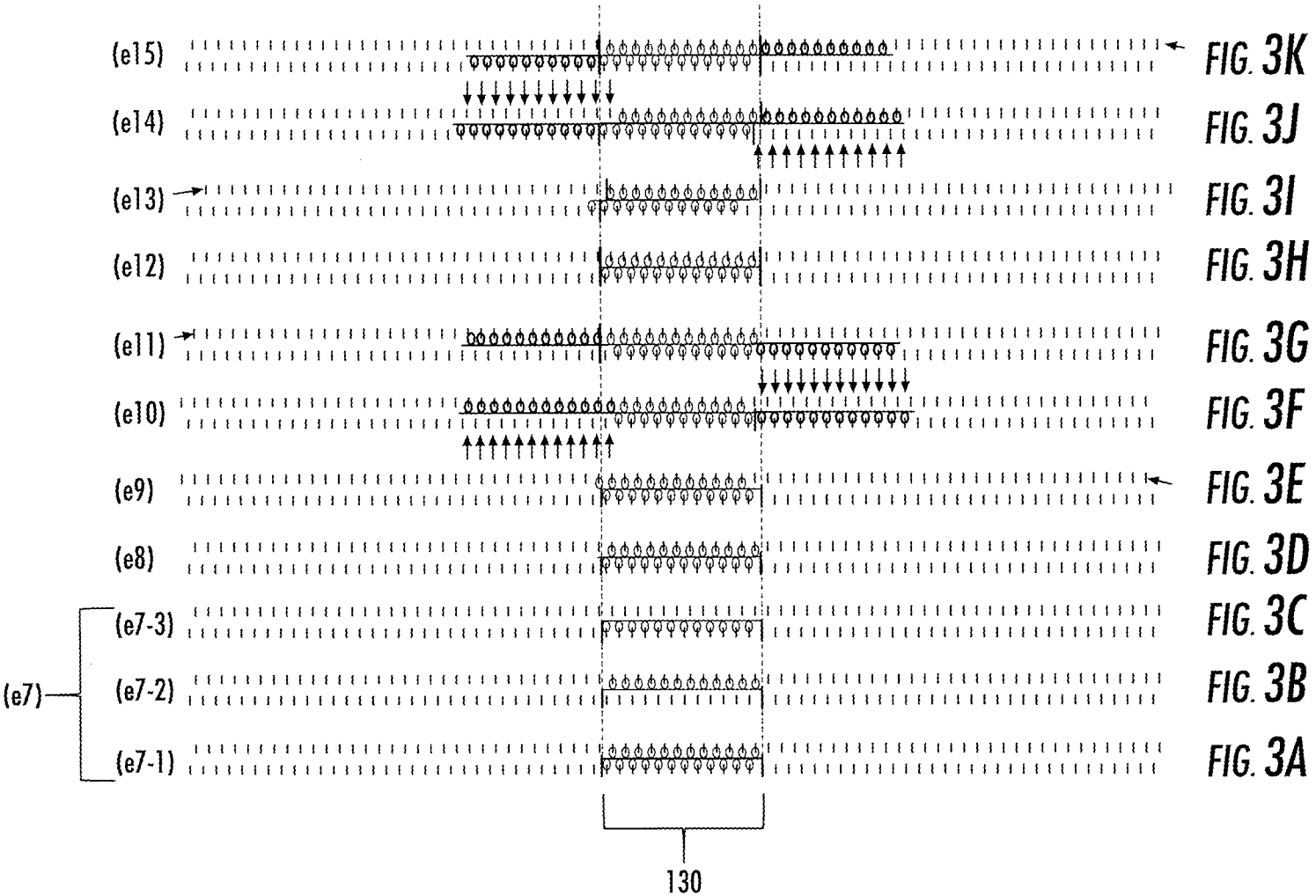
FIGS. 3A-3K illustrate schematically steps of a method of making a knitted shoe component using a V-bed knitting machine according to some embodiments described herein.
Figure 4:
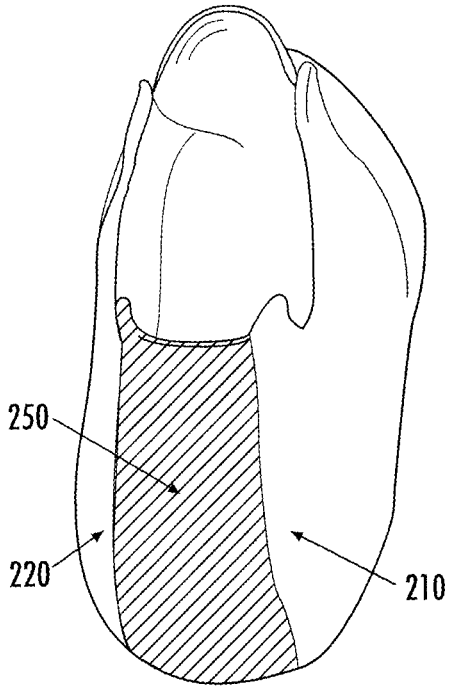
FIG. 4 illustrates a perspective view of a knitted shoe component according to one embodiment described herein.
Figure 5:
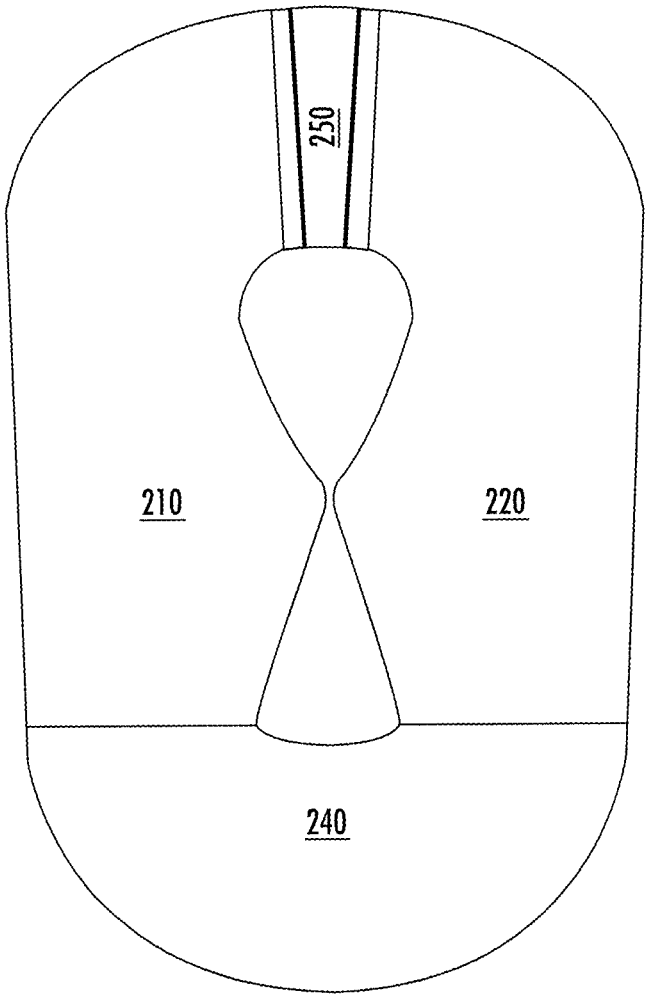
FIG. 5 illustrates a top-down schematic view of a knitted shoe component according to one embodiment described herein.

A method of making a knitted shoe component using a V-bed knitting machine according to one embodiment described herein is illustrated schematically in FIGS. 1-5. Specifically, FIG. 1 illustrates the general nomenclature used for V-bed knitting machine diagrams. FIGS. 2 and 3 illustrate an exemplary method of forming or "closing" the heel portion of a shoe upper formed using a V-bed knitting machine. FIGS. 4 and 5 each illustrate a finished knitted shoe component.

With reference to FIG. 1A and FIG. 1B, a front needle bed (110) and a back needle bed (120) are each depicted schematically as a series of short line segments (111, 121, respectively). The line segments (111, 121) schematically represent individual needles of the front needle bed (110) and the back needle bed (120). When the needles (111, 121) of the front needle bed (110) and the back needle bed (120), respectively, are facing one to one from first to last, the racking of the beds (110, 120) is said to be in the "zero" or "0" position, as illustrated in FIG. 1C. However, it is to be understood that the needle beds (110, 120) in a zero position can also be in a rib gaited arrangement. At various points during operation of the knitting machine, the front needle bed (110) and/or the back needle bed (120) can be "racked" a desired number of needles, as described hereinabove and as illustrated in FIG. 1D. As depicted in FIG. 1D, the back needle bed (120) has undergone a 10-needle racking to the left (as indicated by the arrow pointing to the left in FIG. 1D). However, a needle bed (110, 120) can slide or be racked in either direction (left or right) and may also be racked a different number of needles, other than 10 needles. In addition, racking is generally reversible. For example, as illustrated in FIG. 1E, the front needle bed (110) and the back needle bed (120) are again in a "0" position due to a racking in the opposite direction of the racking in FIG. 1D.

As described herein, a knitted shoe component can be formed from first and second wing portions (or "left" and "right" wings). These wing portions can be initially disposed in a knitting machine in a rib knit configuration. Moreover, the wing portions can be considerably separated from one another in a lateral direction (by an initial separation distance). To successfully join the wing portions to form or close the heel using a knitting process, the wing portions must be moved closer to one another (until a "knitting" separation distance is obtained, which may be about 1 inch in some cases). In general, the distance between wing portions disposed in a V-bed knitting machine as described herein can be reduced by racking. However, it is not possible to carry out a sufficiently large racking with both needle beds tied on a rib knit. Therefore, a series of stitch transfer and racking steps according to a method described herein must be carried out to permit successful closing of the heel. These steps are illustrated schematically in FIGS. 2 and 3. However, for purposes of clarity and emphasis, it should be noted that not every feature is necessarily shown or labeled in each of the various portions of FIGS. 2 and 3.

Figures 2A, 2B, 2C, 2D, 2E, 2F, 2G:
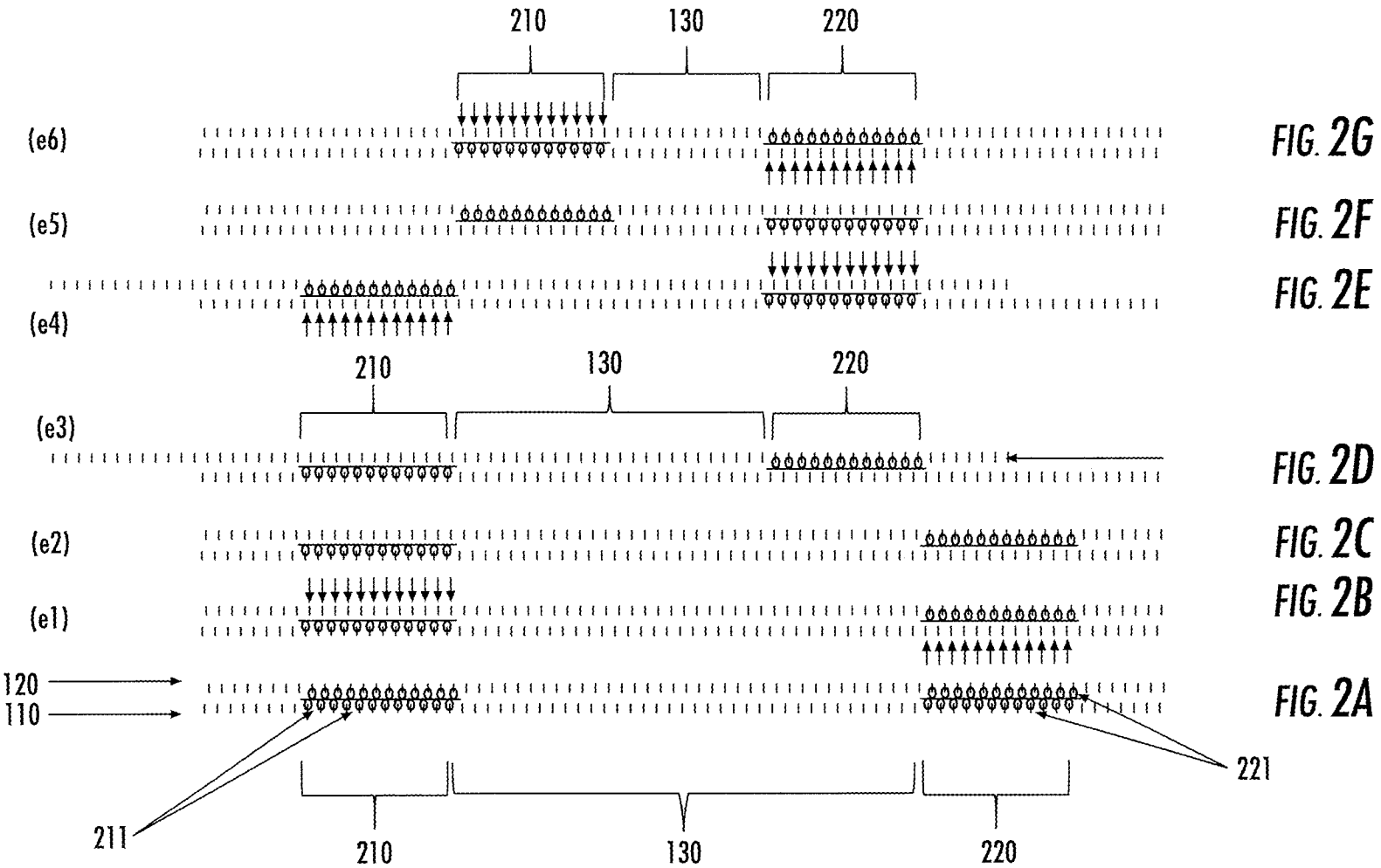
FIGS. 2A-2G illustrate schematically steps of a method of making a knitting shoe component using a V-bed knitting machine according to some embodiments described herein.

With reference to FIG. 2A, a first wing portion or left wing (210) and a second wing portion or right wing (220) are depicted schematically on the front needle bed (110) and the back needle bed (120) of a V-bed knitting machine. For illustration purposes, only the edge of the first wing portion (210) and the edge of the second wing portion (220) are illustrated schematically. Moreover, throughout this example, the term "wing portion" and the associated reference numeral (210 or 220) are used to refer to both a specific wing portion and also the edge of the wing portion, and the context of the reference will be used to provide further clarity. It is also to be understood that the first (210) and second (220) wing portions also include previously knitted materials not shown in FIG. 2A. Additionally, the active stitches (211, 221) of the first (210) and second (220) wing portions (or edges), respectively, are depicted as loops on the needle beds (110, 120). As illustrated in FIG. 2A, the active stitches (211, 221) of the first (210) and second (220) wing portions are disposed in a rib knit configuration, which is depicted as a double loop in FIG. 2A. In addition, there is a gap or lateral separation distance (130) between the first (210) and second (220) wing portions. At the beginning of the heel closing process, the gap (130) can correspond to an initial lateral separation distance described hereinabove.

To reduce the gap or lateral separation distance (130), a series of stitch transfer, racking, and (optionally) knitting steps can be performed in a manner described herein. These steps (denoted as (e1) through (e5)) are illustrated schematically in FIGS. 2B-2F. With reference to FIG. 2B, the method of the present example comprises (e1) transferring the stitches (211) of the first edge or wing portion (210) to the front needle bed (110) and transferring the stitches (221) of the second edge or wing portion (220) to the back needle bed (120), as illustrated by the arrows in FIG. 2B. By transferring the active stitches (211, 221) in this manner, the back needle bed (120) is cleared on the left wing (210), and the front needle bed (110) is cleared on the right wing (220). Next, in FIG. 2C (and step (e2)), at least one additional course is optionally knitted on each of the first (210) and second (220) wings. Then, with reference to FIG. 2D, the method comprises (e3) racking the back needle bed (120) to reduce the lateral separation distance between the first wing portion (110) and the second wing portion (120) from the initial separation distance (130 in FIGS. 2A-2C) to an intermediate separation distance (130 in FIGS. 2D and 2E). As illustrated by the arrow in FIG. 2D, the back needle bed (120) is racked to the left. However, as described above, it is also possible to rack the front needle bed (110) instead, such as to the right in FIG. 2D.

Following the reduction of the gap (130) in FIG. 2D, a step (e4) is carried out in FIG. 2E in which the active stitches (211) of the first edge (210) are transferred from the front needle bed (110) to the back needle bed (120), and the stitches (221) of the second edge (220) are transferred from the back needle bed (120) to the front needle bed (110). Next, with reference to FIG. 2F, a racking step (e5) is carried out in which the back needle bed (120) is racked back to the position of step (e1) to further reduce the lateral separation distance (130) between the first wing portion (210) and the second wing portion (220) from the intermediate separation distance (130 in FIGS. 2D and 2E) to a knitting separation distance (130 in FIGS. 2F and 2G). Again, it is to be understood that although the back needle bed (120) is depicted in FIG. 2 as the bed that is racked, it is also possible to rack the front needle bed (110).

Moreover, once the gap (130) is reduced to a knitting separation distance in a manner described hereinabove, the active stitches (211, 221) of the first (210) and second (220) wing portions can be placed in a position appropriate for beginning the next stage of the method, the heel closure itself, as illustrated in FIG. 2G. In particular, in FIG. 2G, a step (e6) is carried out. Step (e6) comprises transferring the stitches (211) of the first edge (210) from the back needle bed (120) to the front needle bed (110) and transferring the stitches (221) of the second edge (220) from the front needle bed (110) to the back needle bed (120).

Once the first (210) and second (220) wing portions are separated by a knitting distance (130) and the stiches (211, 221) are disposed on the correct needle beds (110, 120), further knitting steps are carried out to complete the shoe component. In the embodiment illustrated in FIG. 3, the first step in this portion of the method is the step (e7) of knitting or forming a welt (230) between the first wing portion (210) and the second wing portion (220). Specifically, the welt (230) is formed by first (e7-1) disposing a plurality of stitches in a rib knit configuration on needles of the front needle bed (110) and the back needle bed (120) within the gap defining the knitting separation distance of the method, as illustrated in FIG. 3A. Next, to form a French welt, the method illustrated in FIG. 3 comprises (e7-2) disposing or knitting a plurality of stitches in a jersey knit configuration on needles of the back needle bed within the gap defining the knitting separation distance of the method (see FIG. 3B); and (e7-3) disposing or knitting a plurality of stitches in a jersey knit configuration on needles of the opposite needle bed (front) as in step (e7-2), the needles being within the gap defining the knitting separation distance (see FIG. 3C) It should be noted that, to form another type of welt, such as an English welt or a racked welt, steps (e7-2) and (e7-3) can be replaced by knitting steps corresponding to these welt types, as understood by one of ordinary skill in the art. Moreover, steps (e7-2) and (e7-3) (or the corresponding steps for other welt types) can be repeated any desired number of times to increase the thickness of the welt.

Following formation of the welt (230), the method of the present example further comprises (e8) knitting at least one additional course on each of the first edge (210) and the second edge (220) to reduce the number of held stitches on each of the first edge (210) and the second edge (220) by at least one stitch (see FIG. 3D; held stitches not shown); and (e9) racking the back needle bed (120) to reduce the lateral separation between the first wing portion (210) and the second wing portion (220) (see FIG. 3E). The method also comprises (e10) transferring the remaining held stitches of the first edge (210) from the front needle bed (110) to the back needle bed (120) and transferring the remaining held stitches of the second edge (220) from the back needle bed (120) to the front needle bed (110) (see FIG. 3F); and (e11) racking the back needle bed (120) back to the position of step (e8) (see FIG. 3G). As illustrated in FIG. 3, the position of (e8) comprises the zero position of the needle beds (110, 120). Following this racking step, a step (e12) is carried out in which at least one additional course is knitted on each of the first edge (210) and the second edge (220) to reduce the number of held stitches on each of the first edge (210) and the second edge (220) by at least one stitch in the same manner as described hereinabove (see FIG. 3H). Next, the back needle bed (120) is racked in step (e13) to reduce the lateral separation between the first wing portion (210) and the second wing portion (220), where the racking of step (e13) is carried out in a direction opposite to that carried out in step (e9) above (see FIG. 3I). The method further comprises (e14) transferring the stitches of the first edge (210) from the back needle bed (120) to the front needle bed (110) and transferring the stitches of the second edge (220) from the front needle bed (110) to the back needle bed (120) (see FIG. 3J); and (e15) racking the back needle bed (120) back to the position of step (e8) (see FIG. 3K).

To complete foil cation of the heel portion, steps (e8) through (e15) are repeated until substantially all of the stitches of the first edge (210) and substantially all of the stitches of the second edge (220) have been used to knittingly join the first wing portion (210) to the second wing portion (220) to form the heel portion. Thus, in this manner, a V-bed knitting machine can be used to provide a knitted shoe upper that is entirely or substantially entirely formed into a three-dimensional shape using a knitting process only, as opposed to a knitting process in combination with another joining process, such as a sewing or linking process.

The finished knitted shoe component (200) formed by the method is illustrated in FIG. 4 and FIG. 5. FIG. 4 illustrates a perspective view of the knitted shoe component (200) comprising a first wing portion (210) and a second wing portion (220) knittingly joined together to form a heel portion (250). FIG. 5 illustrates a schematic top-down view of the fabric of the knitted shoe component (200), with all contours in the dimension perpendicular to the page of FIG. 5 flattened for illustration purposes. As shown in FIG. 5 and as described herein, the knitted shoe component (200) is formed by first knitting the toe portion (240) and then the first (210) and second (220) wing portions, followed by forming the heel portion (250) in a manner described hereinabove.

EXAMPLE 2

Four-Bed Flat Knitting

Figure 6:
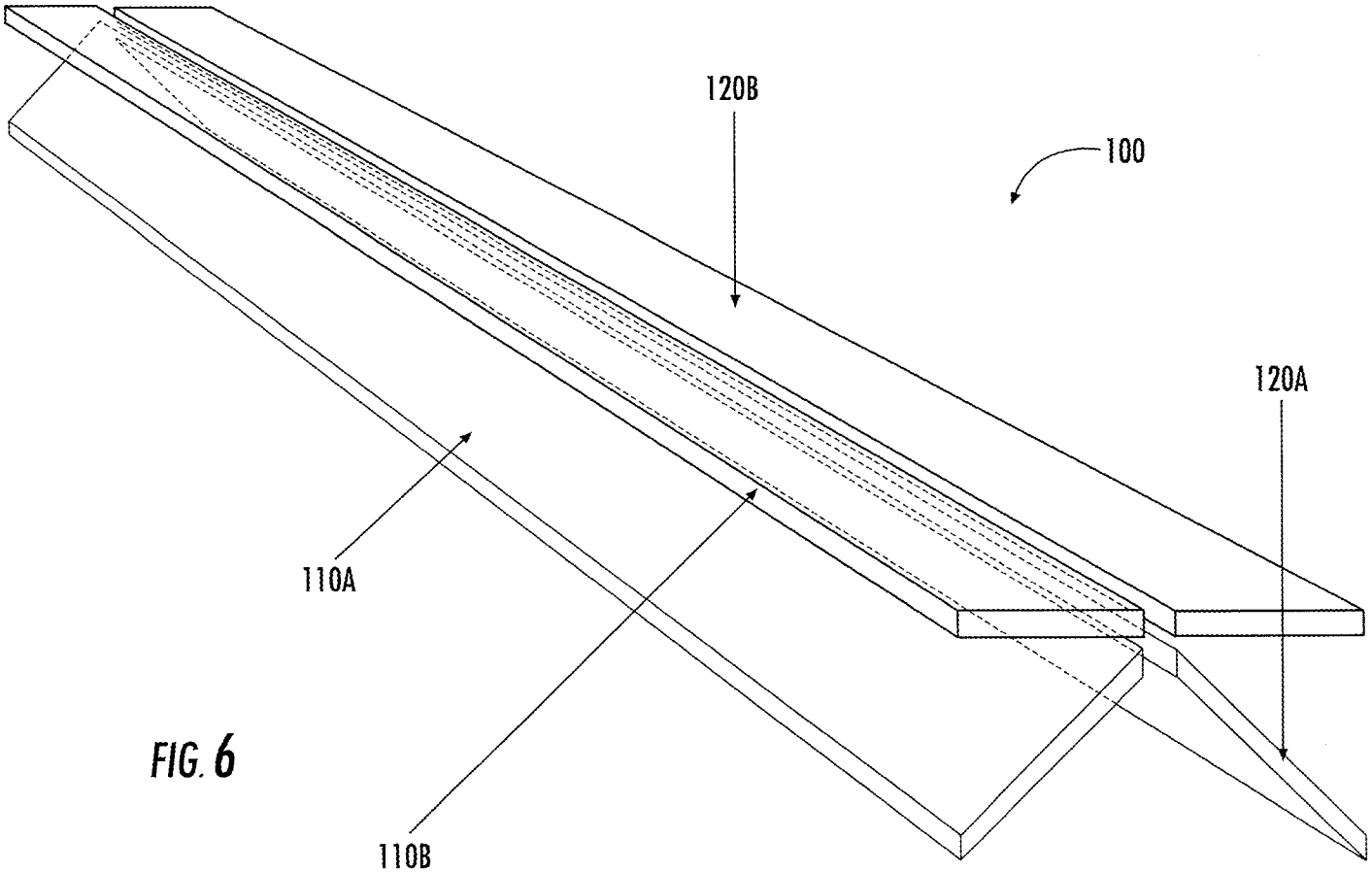
FIG. 6 illustrates a perspective view of a four-bed flat knitting machine used to carry out a method of making a knitted shoe component according to some embodiments described herein.

A method of making a knitted shoe component using a four-bed flat knitting machine according to one embodiment described herein is illustrated schematically in FIGS. 6-8. Specifically, FIG. 6 illustrates a perspective view of a four-bed flat knitting machine (100) that can be used to perform the method, and FIGS. 7 and 8 illustrate numbered steps of an exemplary method of forming or "closing" the heel portion of a shoe upper formed using a four-bed flat knitting machine such as the machine (100) of FIG. 6. The knitting machine of FIG. 6 comprises a front V needle bed (110A), a back V needle bed (120A), a front top needle bed (110B) and a back top needle bed (120B). For convenience of reference, the front V needle bed (110A) and the front top needle bed (110B) may be referred to collectively as the "front needle beds (110)." Similarly, the back V needle bed (120A) and the back top needle bed (120B) may be referred to collectively as the "back needle beds (120)." Further, as illustrated in FIG. 7 and FIG. 8, the front needle beds (110) and the back needle beds (120) can each be depicted schematically as "double" needle beds, in contrast to the "single" needle beds depicted in the figures associated with Example 1 above, where a "double" needle bed includes two needles per lateral position. More particularly, as illustrated in FIGS. 7 and 8, a dashed box containing two needles is used to represent the needle of each back bed (or each front bed) corresponding to the same general lateral position. The "left" needles in each box and the "right" needles in each box, respectively, refer to needles of a different needle bed. For example, the right needle within a given box depicted in the front needle beds (110) can refer to a needle of the front top needle bed (110B) and the left needle within a given box depicted in the front needle beds (110) can refer to a needle of the front V needle bed (110A). Additionally, when reference is made to transferring stitches from the front needle beds to the back needle beds (or vice versa), it is to be understood that the transfer can be from a specific front needle bed (i.e., the front V needle bed or the front top needle bed) and to a specific back needle bed (i.e., the back V needle bed or the back top needle bed), as described, for instance, with reference to step (e1) below.

Figures 7A, 7B, 7C, 7D, 7E, 7F, 7G:
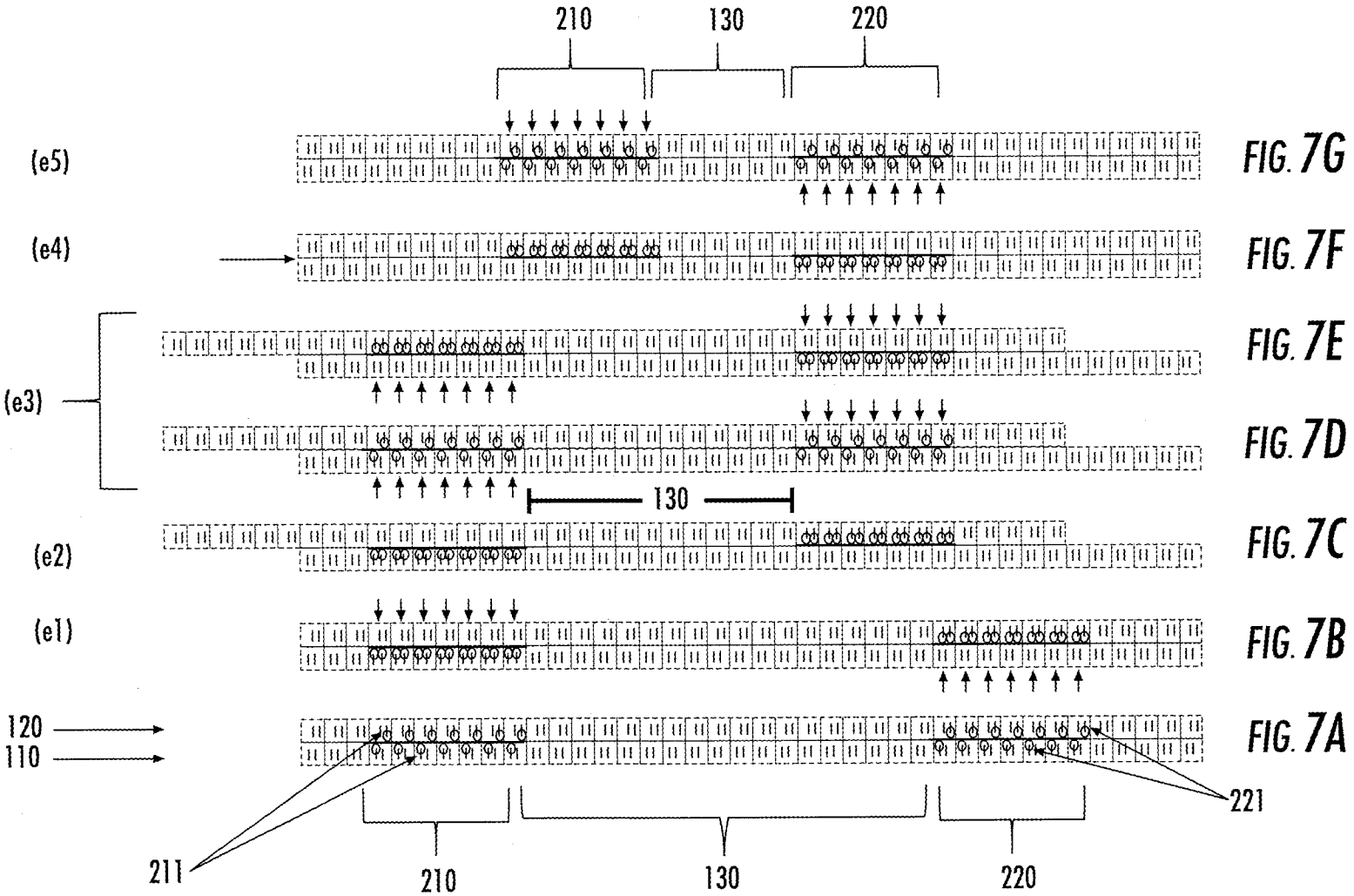
FIGS. 7A-7G illustrate schematically steps of a method of making a knitted shoe component using a four-bed knitting machine according to some embodiments described herein.

As illustrated in FIGS. 7 and 8, first and second wing portions (or "left" and "right" wings) (210 and 220, respectively), which are initially provided in rib knit configuration, are considerably separated by an initial separation distance (130 in FIG. 7A and FIG. 7B). To successfully close the heel using a knitting process, the wing portions (210, 220) must be moved closer to one another (until a "knitting" separation distance is obtained, which may be about 1 inch). The distance can be reduced by racking. However, it is not possible to carry out a sufficiently large racking with the needle beds (110A, 110B, 120A, 120B) tied on a rib knit. Therefore, a series of stitch transfer and racking steps according to a method described herein must be carried out to permit successful closing of the heel. These steps are illustrated schematically in FIGS. 7 and 8. However, for purposes of clarity and emphasis, it should be noted that not every feature is necessarily shown or labeled in each of the various portions of FIGS. 7 and 8.

With reference to FIG. 7A, a first wing portion (210) can be knittingly joined to a second wing portion (220) to form a heel portion, as described herein. In addition, as in Example 1 above, the wing portions (210, 220) in FIGS. 7 and 8 are illustrated schematically to represent the edges of the wing portions (210, 220). Knitting the first wing portion (210) to the second wing portion (220) to form the heel portion or "close the heel" is carried out by (e1) transferring stitches (211) of the first edge (210) from the back V needle bed (120A) to the front top needle bed (110B) and transferring stitches (221) of the second edge (220) from the front V needle bed (110A) to the back top needle bed (120B) (FIG. 7B); (e2) racking the back needle bed(s) (120) to reduce the lateral separation distance (130) between the first wing portion (210) and the second wing portion (220) from the initial separation distance (130 in FIG. 7A and FIG. 7B) to an intermediate separation distance (130 in FIG. 7C); (e3) transferring the stitches (211) of the first edge (210) from the front top needle bed (110B) to the back V needle bed (120A) and from the front V needle bed (110A) to the back top needle bed (120B), and transferring the stitches (221) of the second edge (220) from the back top needle bed (120B) to the front V needle bed (110A) and from the back V needle bed (120A) to the front top needle bed (110B) (FIG. 7D and FIG. 7E); and (e4) racking the back needle beds (120) back to the position of step (e1) to reduce the lateral separation (130) between the first wing portion (210) and the second wing portion (220) from the intermediate separation distance (130 in FIG. 7C) to a knitting separation distance (130 in FIG. 7F). As described above for a V-bed knitting machine, it is to be noted that racking may also be carried out using the front needle beds (110).

Figures 8A, 8B, 8C, 8D, 8E, 8F, 8G, 8H, 8I, 8J:
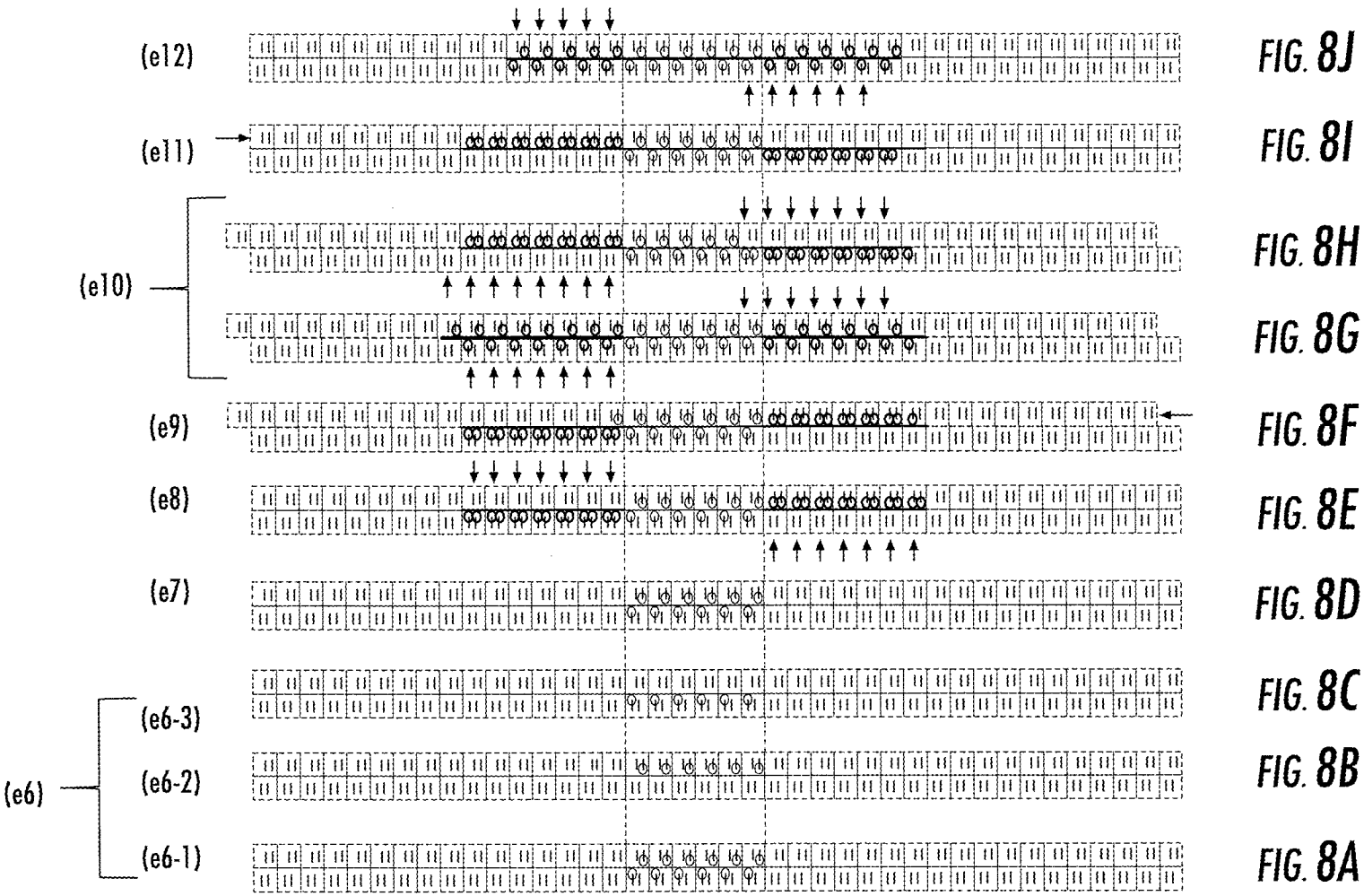
FIGS. 8A-8J illustrate schematically steps of a method of making a knitted shoe component using a four-bed knitting machine according to some embodiments described herein.

In addition, as with a method carried out using a V-bed knitting machine, once a knitting separation distance (130) between the wing portions (210, 220) is obtained, it is possible to carry out additional knitting steps with the four-bed knitting machine (100) to form a seamless knitted shoe component. As illustrated in FIG. 7G, knitting the first wing portion (210) to the second wing portion (220) further comprises (e5) transferring the stitches (211) of the first edge (210) from the back top needle bed (120B) to the front V needle bed (110A) and transferring the stitches (221) of the second edge (220) from the front top needle bed (110B) to the back V needle bed (120A). Next, knitting or forming a welt (230) is carried out in a plurality of knitting steps (collectively (e6)). Specifically, the welt (230) is formed by first (e6-1) disposing a plurality of stitches in a rib knit configuration on needles of the front needle beds (110) and the back needle beds (120) within the gap defining the knitting separation distance of the method, as illustrated in FIG. 8A. Next, to form a French welt, the method illustrated in FIG. 8 comprises (e6-2) disposing or knitting a plurality of stitches in a jersey knit configuration on needles of the back needle bed(s) within the gap defining the knitting separation distance (see FIG. 8B); and (e6-3) disposing or knitting a plurality of stitches in a jersey knit configuration on needles of the opposite needle bed(s) as in step (e6-2), the needles being within the gap defining the knitting separation distance (see FIG. 8C). It should be noted that, to form another type of welt, such as an English welt or a racked welt, steps (e6-2) and (e6-3) can be replaced by knitting steps corresponding to these welt types, as understood by one of ordinary skill in the art. Moreover, steps (e6-2) and (e6-3) (or the corresponding steps for other welt types) can be repeated any desired number of times to increase the thickness of the welt.

Following formation of the welt (230), the method further comprises (e7) knitting at least one additional course on each of the first edge (210) and the second edge (220) to reduce the number of held stitches on each of the first edge (210) and the second edge (220) by at least one stitch (FIG. 8D; held stitches not shown); (e8) transferring the remaining held stitches (211) of the first edge (210) from the back V needle bed (120A) to the front top needle bed (110B) and transferring the remaining held stitches (221) of the second edge (220) from the front V needle bed (110A) to the back top needle bed (120B) (FIG. 8E); (e9) racking the back needle beds (120) to reduce the lateral separation (130) between the first wing portion (210) and the second wing portion (220) (FIG. 8F); (e10) transferring the remaining held stitches of the first edge (210) from the front top needle bed (110B) to the back V needle bed (120A) and from the front V needle bed (110A) to the back top needle bed (120B), and transferring the remaining held stitches of the second edge (220) from the back top needle bed (120B) to the front V needle bed (110A) and from the back V needle bed (120A) to the front top needle bed (110B) (FIGS. 8G and 8H); and (e11) racking the back needle beds (120) back to the position of step (e7) (FIG. 8I). The position of step (e7), as illustrated in FIG. 8, comprises a zero position of the needle beds (110, 120) and/or the knitting machine (100). The method further comprises (e12) transferring the remaining held stitches of the first edge (210) from the back top needle bed (120B) to the front V needle bed (110A) and transferring the remaining held stitches of the second edge (220) from the front top needle bed (110B) to the back V needle bed (120A) (FIG. 8J).

To complete formation of the heel portion, steps (e7) through (e12) are repeated until substantially all of the stitches of the first edge (210) and substantially all of the stitches of the second edge (220) have been used to knittingly join the first wing portion (210) to the second wing portion (220) to form the heel portion.

EXAMPLE 3

Knitted Shoes and Shoe Components

Figure 9:
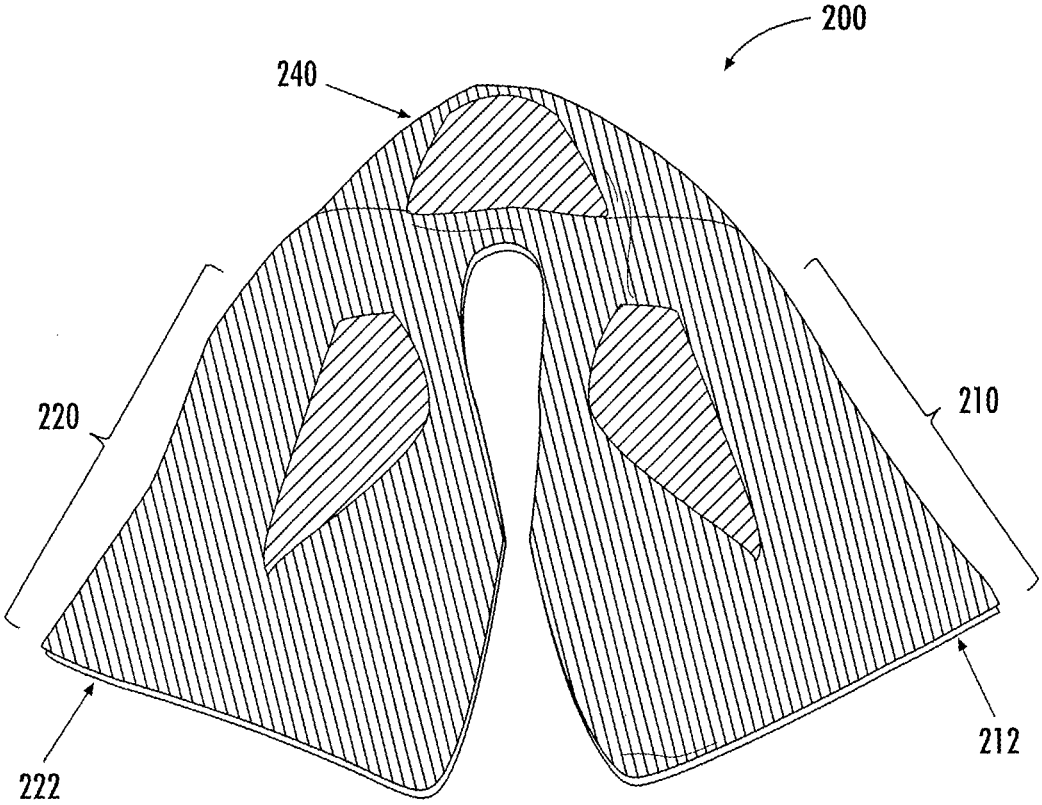
FIG. 9 illustrates a perspective view of a knitted fabric used to form a knitted shoe component according to one embodiment described herein.

Knitted shoes, shoe components, and fabrics used to form such shoes and components according to some embodiments described herein are illustrated in FIGS. 9-20. For example, FIG. 9 illustrates a portion of a knitted fabric (200) used to form a knitted shoe component described herein. As illustrated in FIG. 9, the first wing portion (210) and the second wing portion (220) of the fabric (200) have not yet been knittingly joined at their edges (212, 222) to form the heel portion of the knitted shoe component. The fabric (200) also includes a previously knitted toe portion (240).

Figure 10:
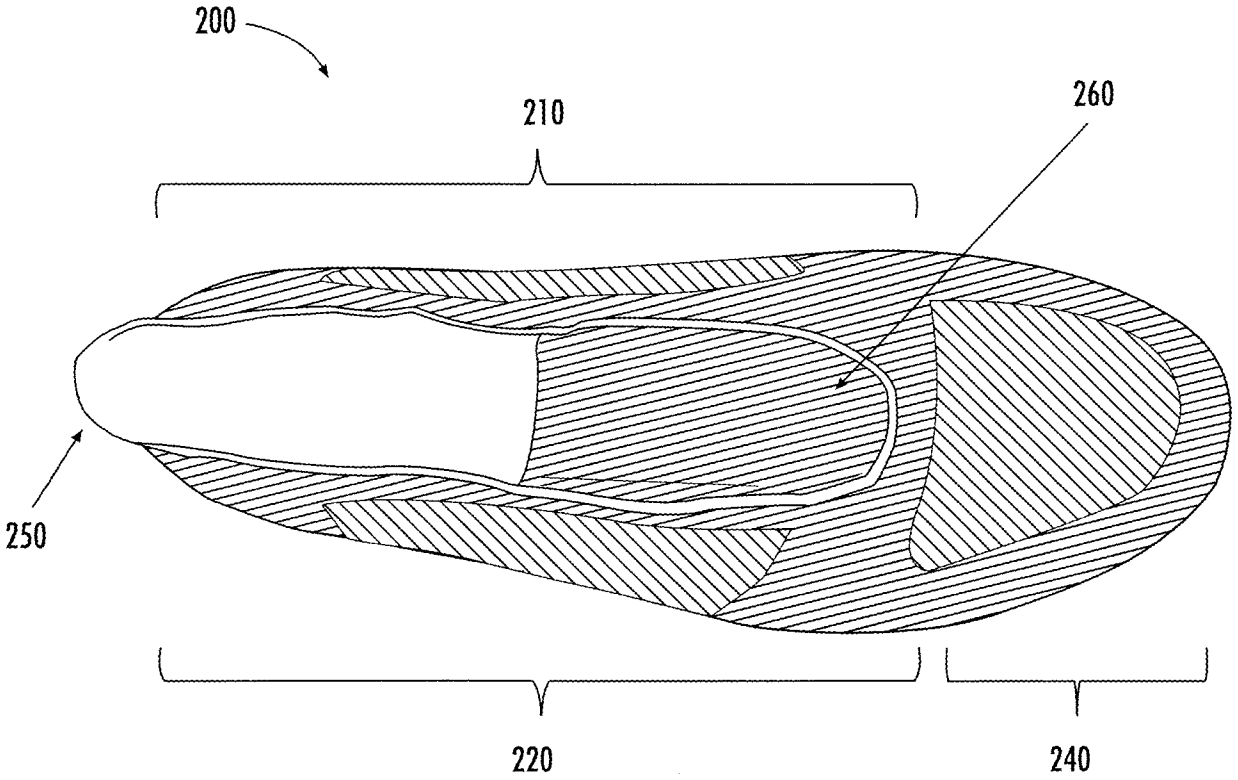
FIGS. 10-13 each illustrates a perspective view of a knitted shoe component according to one embodiment described herein.
Figure 11:
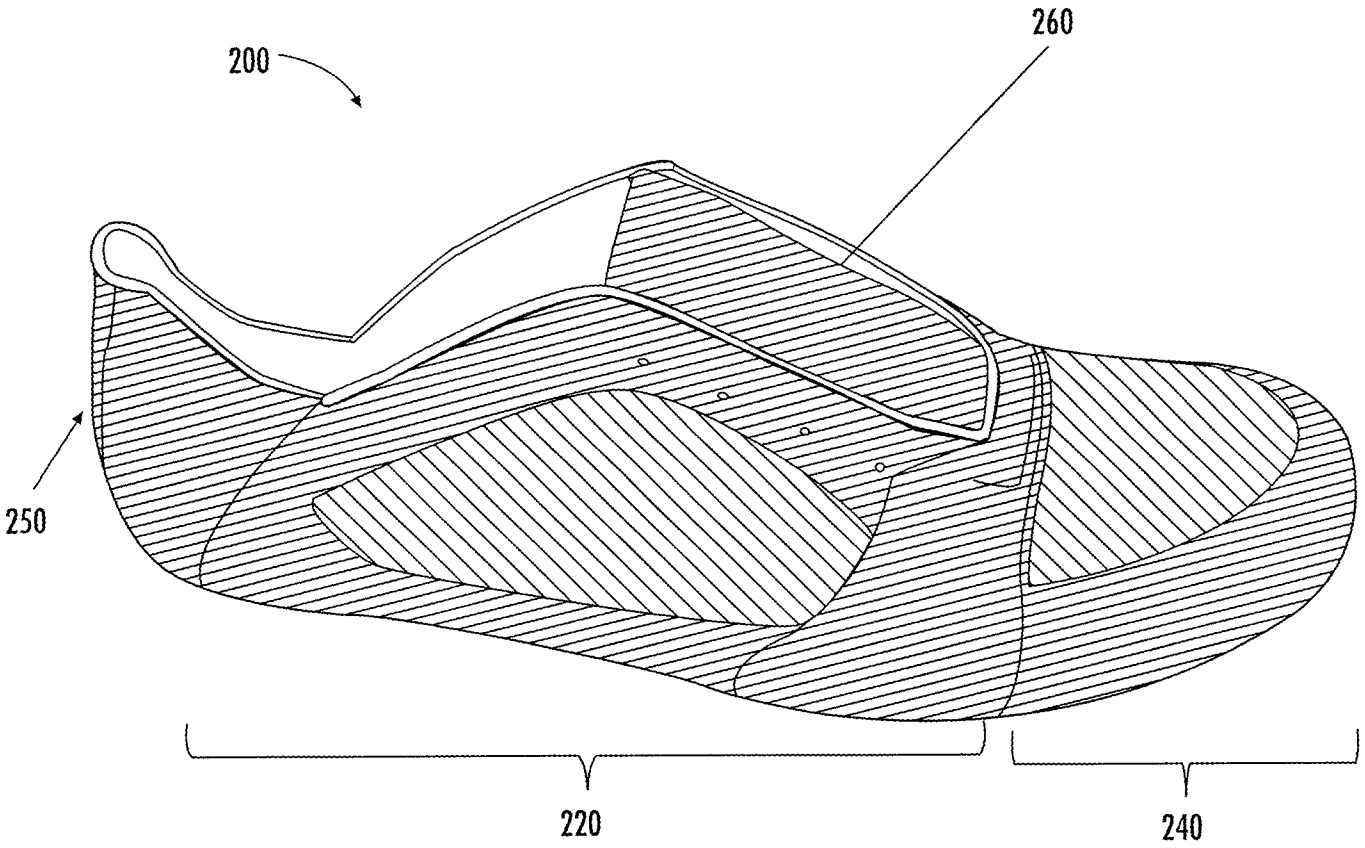

FIGS. 10-13 illustrate different views of a finished knitted shoe upper (200) described herein. Specifically, FIG. 10 is a top view of the knitted shoe upper (200). As illustrated in FIG. 10, the knitted shoe upper (200) includes a first wing portion (210) that forms a medial side of the shoe upper (200); a second wing portion (220) that forms a lateral side of the shoe upper (200); a toe portion (240) knittingly connected to the first wing portion (210) and the second wing portion (220); and a heel portion (250) formed by the joining the first wing portion (210) and the second wing portion (220), and knittingly connected to the first wing portion (210) and the second wing portion (220). In addition, the knitted shoe upper (200) of FIG. 10 also includes a tongue portion (260). As described further hereinabove, the tongue portion (260) can be sewn into a seamless knitted shoe component defined by the first wing portion (210), the second wing portion (220), the toe portion (240), and the heel portion (250). FIG. 11 is a perspective view of the knitted shoe upper (200) of FIG. 10.

Figure 12:
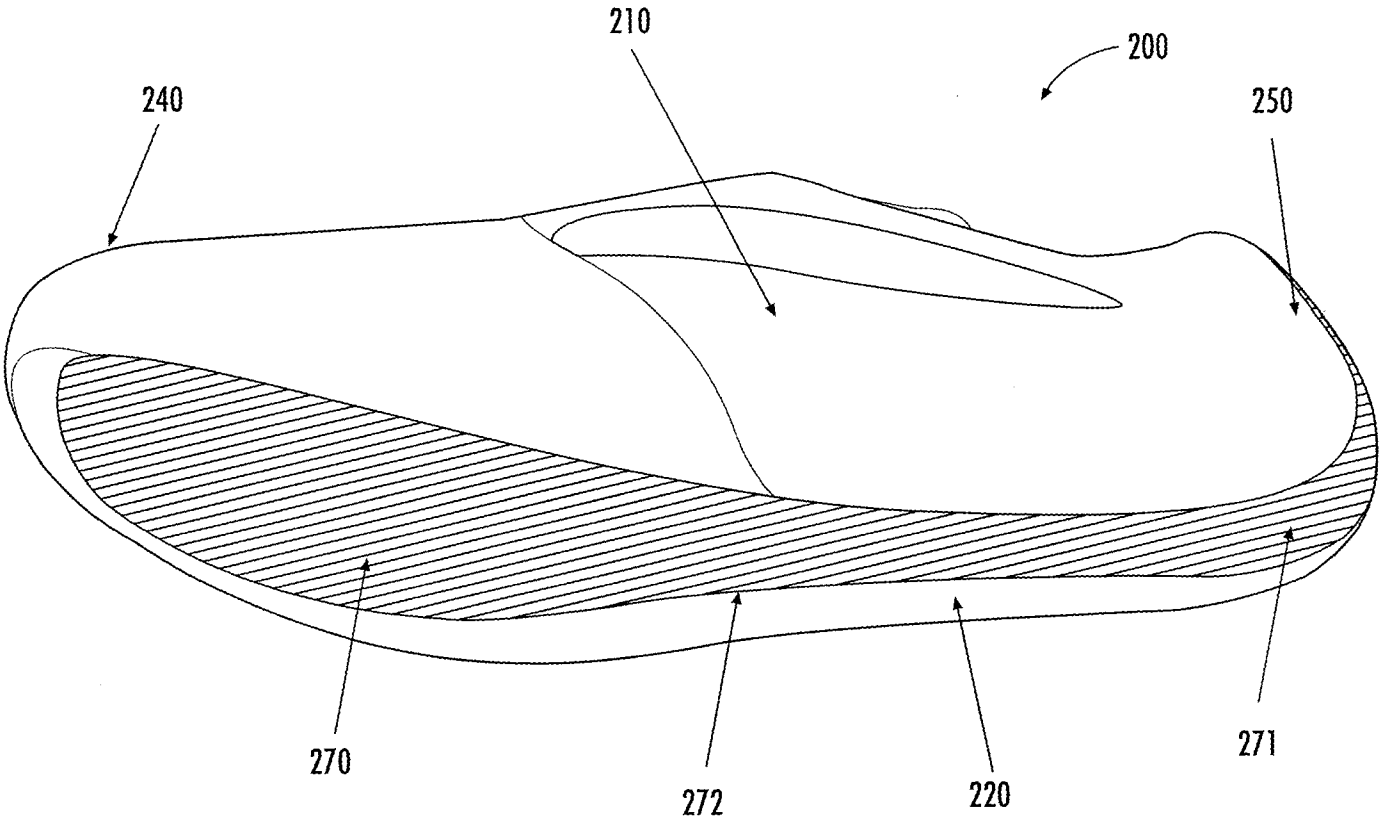
Figure 13:
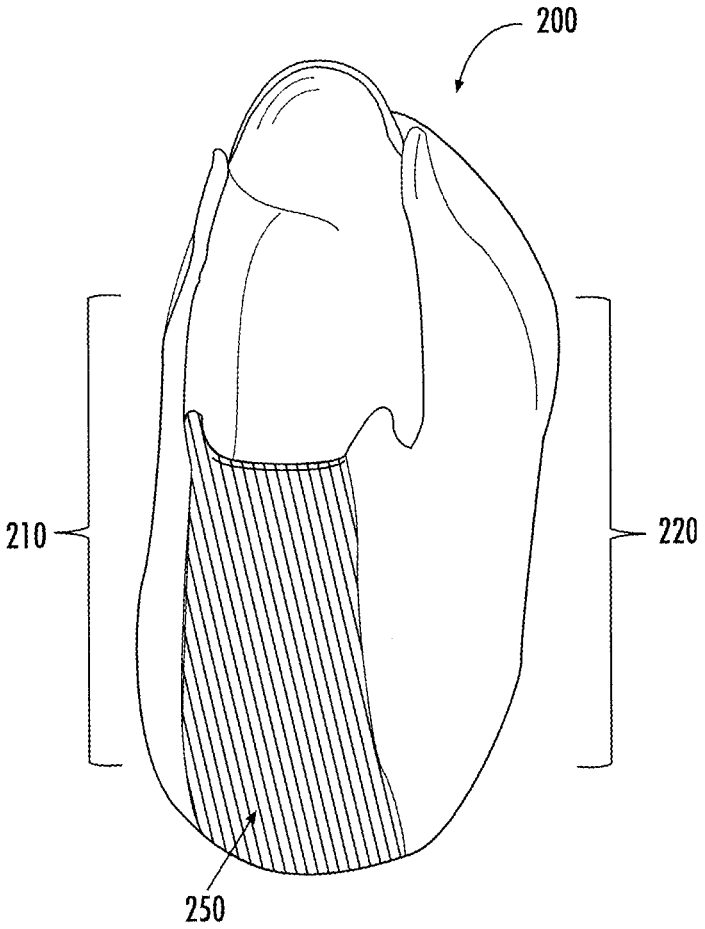
Figure 14A:
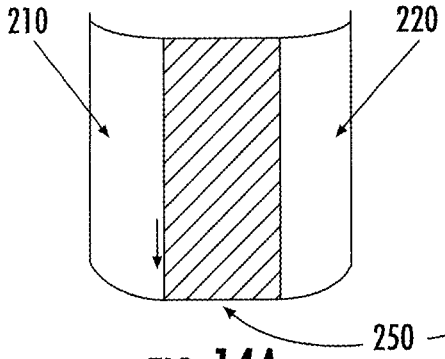
FIGS. 14A, 15A, 16A, 17A, 18A, and 19A each illustrate a side view of the back of a knitted shoe component.
Figure 14B:
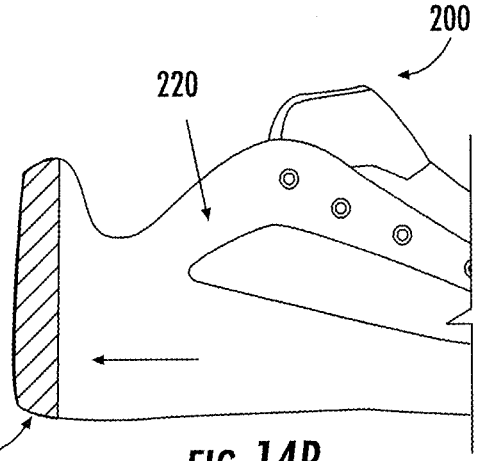
FIGS. 14B, 15B, 16B, 17B, 18B, and 19B illustrate side views of the knitted shoe components of FIGS. 14A, 15A, 16A, 17A, 18A, and 19A, respectively.
Figure 15A:
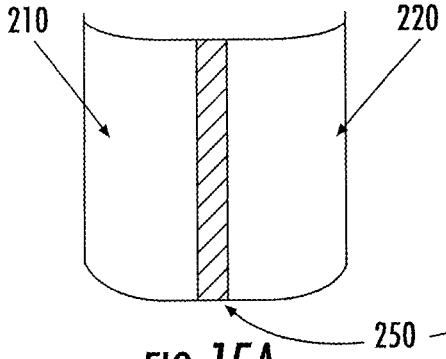
Figure 15B:
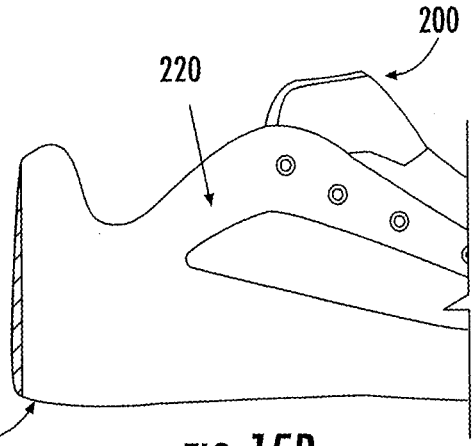
Figure 16A:
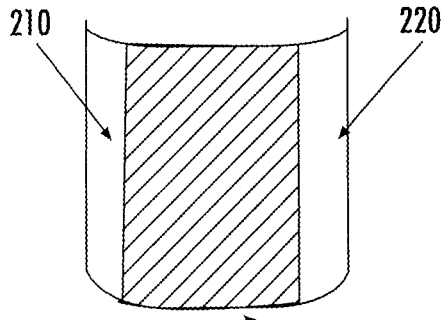
Figure 16B:
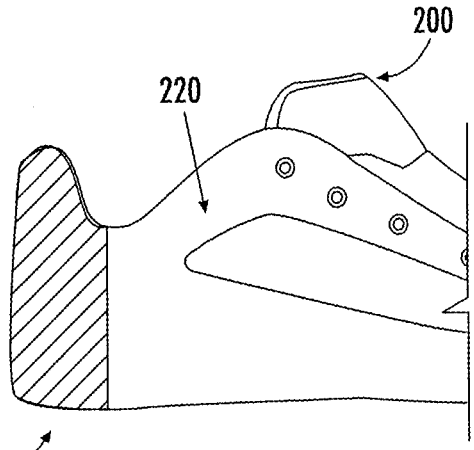
Figure 17A:
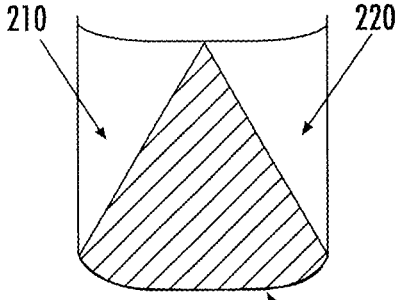
Figure 17B:
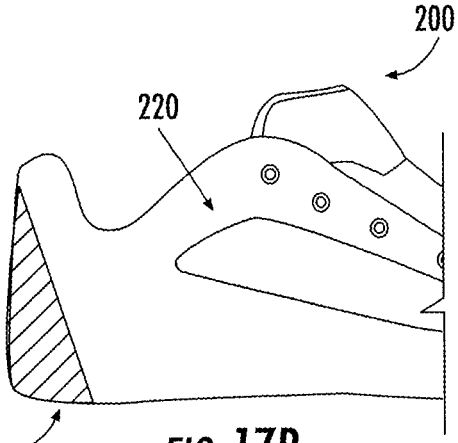
Figure 18A:
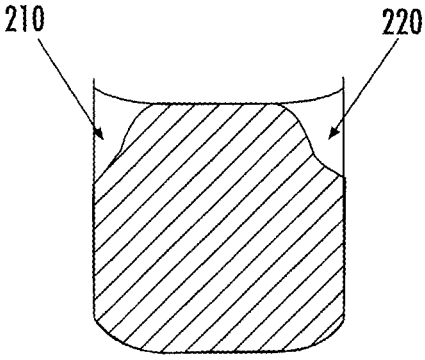
Figure 18B:
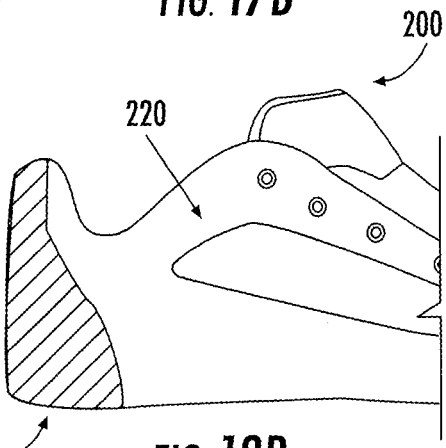
Figure 19A:
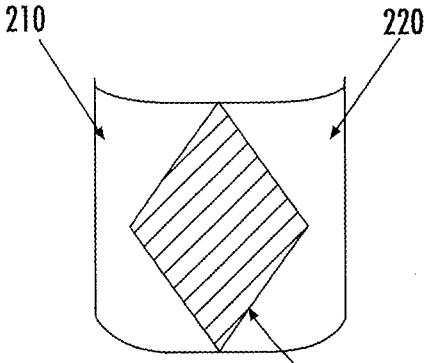
Figure 19B:
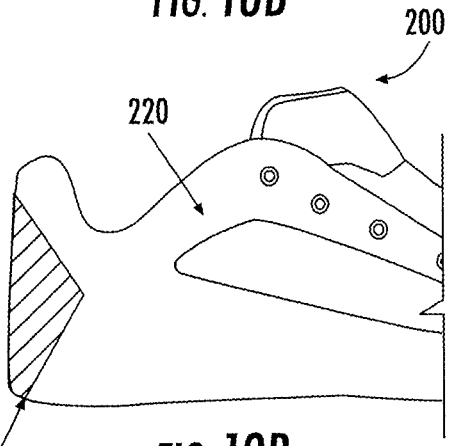

FIG. 12 is a perspective view of the knitted shoe upper (200) of FIGS. 10 and 11. In particular, FIG. 12 illustrates an insole portion (270) of the shoe upper (200). As depicted in FIG. 12, the insole portion (270) is highlighted for clarity. Moreover, as described further hereinabove, the insole portion (270) is knittingly and seamlessly connected to the heel portion (250) of the shoe upper (200) at a knitted junction in a rear insole region (271) of the shoe upper (200). In addition, the insole portion (270) is joined to the first wing portion (210), the second wing portion (220), and the toe portion (240) at a seam (272), which may be formed by a sewing operation. FIG. 13 is a perspective view of the heel portion (250) of the knitted shoe upper (200). As depicted in FIG. 13, the heel portion (250) is highlighted for clarity.

As illustrated in FIGS. 10-13, the heel portion (250) of the knitted shoe upper (200) has a relatively wide, rectangular configuration. However, it is also possible for a heel portion described herein to have other sizes and/or shapes. For example, FIGS. 14-19 illustrate alternative configurations and structures for the heel portion (250) of a knitted shoe component (200) described herein. As illustrated in each of FIGS. 14-19, the heel portion (250) is highlighted. FIGS. 14A, 15A, 16A, 17A, 18A, and 19A each illustrates a view of the back of the shoe component (200), from the perspective of an observer looking toward the heel portion (250). FIGS. 14B, 15B, 16B, 17B, 18B, and 19B illustrate side views of the shoe components (200) of FIGS. 14A, 15A, 16A, 17A, 18A, and 19A, respectively. The arrow in FIG. 14B indicates the direction of knitting during formation of the wing portions (only the second wing portion (220) is visible in FIG. 14B).

Figure 20:
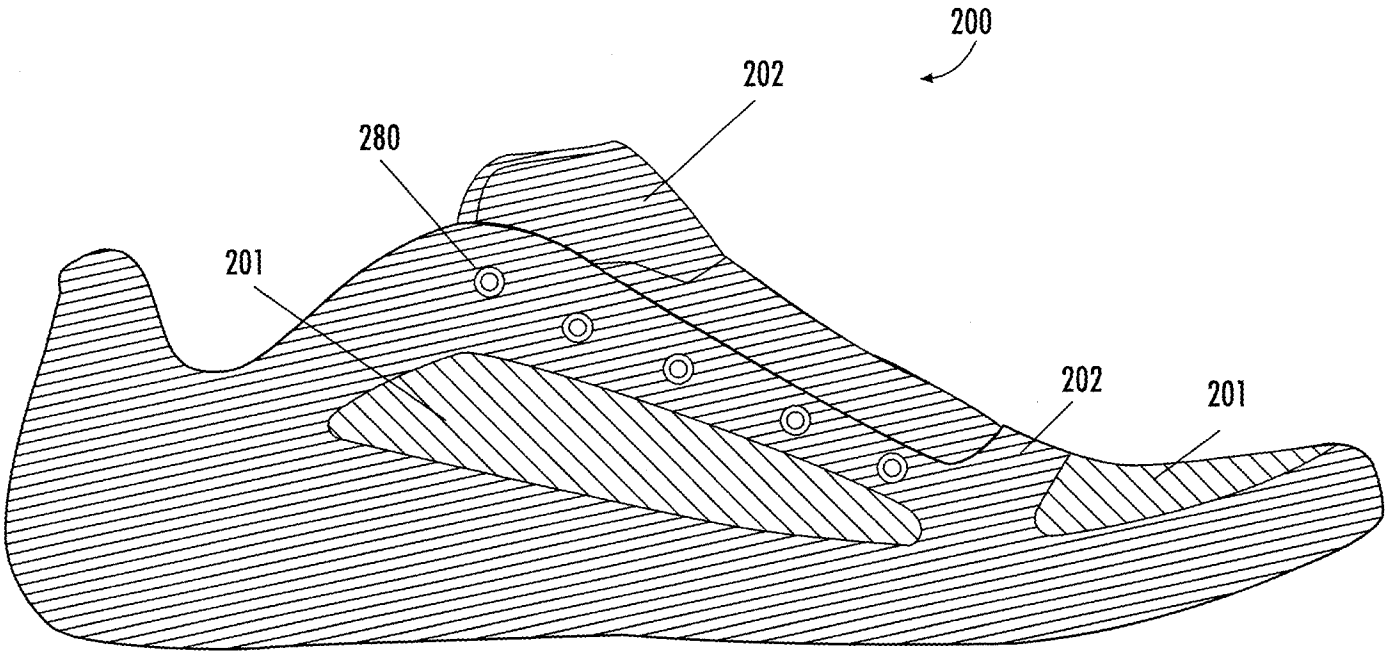
FIG. 20 illustrates a side view of a knitted shoe component according to one embodiment described herein.

Moreover, as described hereinabove, a knitted shoe component such as a knitted shoe upper can have a variety of regions or zones of the same or differing properties. As one non-limiting example, FIG. 20 illustrates a knitted shoe upper (200) having regions of higher breathability (achieved with a loose knit construction) (201) and areas of lower breathability (achieved with a tight knit construction) (202). The shoe upper (200) illustrated in FIG. 20 also includes stitch reinforced eyelets (280). Other configurations of a knitted shoe upper are also possible.

Various embodiments of the present invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

What is claimed is:

1. A knitted shoe component comprising:

a toe portion;

a first wing portion extending from the toe portion and knittingly joined to the toe portion;

a second wing portion extending from the toe portion and knittingly joined to the toe portion; and a heel portion, wherein the first wing portion comprises a first edge and the second wing portion comprises a second edge, wherein said first edge and said second edge are knittingly joined to one another through a single welt at the heel portion, defining a seamless connection between said first edge and said second edge.

2. The knitted shoe component of claim 1 further comprising:

an insole portion extending from the heel portion and knittingly joined to the heel portion.

3. The knitted shoe component of claim 1, wherein the knitted shoe component is a seamless component.

4. The knitted shoe component of claim 1, wherein the knitted shoe component comprises a first welt in the toe portion and a second welt in the heel portion.

5. The knitted shoe component of claim 1, wherein:

the knitted shoe component comprises at least a first region and a second region; and the first region and the second region exhibit differing relative rigidity, elasticity, support, softness, cushioning, compression, breathability, weight, density, color, water wicking ability, or water resistance.

6. The knitted shoe component of claim 1, wherein:

the knitted shoe component comprises one or more relatively soft regions and one or more relatively abrasion resistant regions;

the soft region is located in the interior of the knitted shoe component, relative to a foot of a wearer; and the abrasion resistant region is located on the exterior of the knitted shoe component, relative to the foot of the wearer.

7. The knitted shoe component of claim 1, wherein the knitted shoe component does not have a uniform or substantially uniform thickness.

8. The knitted shoe component of claim 7, wherein the knitted shoe component defines contours or ridges.

9. The knitted shoe component of claim 1, wherein the knitted shoe component is a shoe upper.

10. The knitted shoe component of claim 9 further comprising a plurality of eyelets integral with the first wing portion, the second wing portion, or both.

11. The knitted shoe component of claim 1, wherein the knitted shoe component is an interior lining of a shoe.

12. The knitted shoe component of claim 1, wherein the knitted shoe component is formed from knitted fibers, filaments, or yarns.

13. The knitted shoe component of claim 12, wherein the fibers, filaments, or yarns are coated with a fluorocarbon.

14. The knitted shoe component of claim 12, wherein the fibers, filaments, or yarns comprise one or more additives selected from polymer additives, thermally conductive additives, ceramic additives, metal additives, carbon fibers, carbon nanotubes, graphite nanoplatelets, thermochromic pigments, photochromic pigments, dye materials, antimicrobial materials, antifungal materials, or a combination thereof.

15. The knitted shoe component of claim 12, wherein the fibers, filaments, or yarns comprise a synthetic material selected from the group consisting of a polyamide, polyester, polyethylene, polypropylene, polybutylene, polyolefin, and polyacrylic, or a natural material selected from the group consisting of cotton, wool, silk, and cellulose.

16. A shoe comprising:

the knitted shoe component of claim 1; and one or more additional shoe components attached to the knitted shoe component.

17. The shoe of claim 16, wherein the one or more additional shoe components comprises a tongue component.

18. The shoe of claim 16, wherein the one or more additional shoe components comprises a sole component.

* * * * *